US006897002B2

(12) United States Patent
Teraoka et al.

(10) Patent No.: US 6,897,002 B2
(45) Date of Patent: May 24, 2005

(54) LIQUID DEVELOPER, IMAGE-FIXING APPARATUS USING THE SAME, AND IMAGE-FORMING APPARATUS USING THE SAME

(75) Inventors: Tsutomu Teraoka, Kanagawa (JP); Tsutomu Sasaki, Kanagawa (JP); Tsuneo Kurotori, Tokyo (JP); Masahiko Itaya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 64 days.

(21) Appl. No.: 10/393,941

(22) Filed: Mar. 24, 2003

(65) Prior Publication Data

US 2003/0186157 A1 Oct. 2, 2003

(30) Foreign Application Priority Data

Mar. 25, 2002 (JP) ..... 2002-082505

(51) Int. Cl.[7] ..... G03G 9/125

(52) U.S. Cl. ..... 430/114; 430/116; 399/57; 399/237

(58) Field of Search ..... 430/114, 116; 399/57, 237

(56) References Cited

U.S. PATENT DOCUMENTS

| | | | | | |
|---|---|---|---|---|---|
| 5,263,698 | A | | 11/1993 | Higuchi et al. | |
| 5,402,220 | A | | 3/1995 | Tanaka et al. | |
| 5,463,447 | A | | 10/1995 | Kurotori et al. | |
| 5,642,188 | A | * | 6/1997 | Mochizuki et al. | 399/237 |
| 5,678,158 | A | | 10/1997 | Kurotori et al. | |
| 5,708,938 | A | | 1/1998 | Takeuchi et al. | |
| 5,809,388 | A | | 9/1998 | Inada et al. | |
| 5,937,247 | A | | 8/1999 | Takeuchi et al. | |
| 5,987,281 | A | | 11/1999 | Kurotori et al. | |
| 6,038,421 | A | | 3/2000 | Yoshino et al. | |
| 6,108,508 | A | | 8/2000 | Takeuchi et al. | |
| 6,150,006 | A | | 11/2000 | Hellmann et al. | |
| 6,154,624 | A | | 11/2000 | Sasaki et al. | |
| 6,207,336 | B1 | * | 3/2001 | Itaya et al. | 430/119 |
| 6,287,741 | B1 | * | 9/2001 | Marko | 430/115 |
| 6,405,008 | B1 | | 6/2002 | Obu et al. | |
| 6,466,757 | B2 | | 10/2002 | Itaya et al. | |
| 6,501,932 | B2 | | 12/2002 | Obu et al. | |
| 6,515,747 | B1 | | 2/2003 | Satoh et al. | |
| 6,539,191 | B2 | | 3/2003 | Itaya | |
| 6,692,881 | B2 | * | 2/2004 | Tsubuko et al. | 430/116 |
| 6,738,592 | B2 | * | 5/2004 | Sasaki et al. | 399/237 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A liquid developer which includes an insulating liquid, and toner fine particles containing a coloring agent and a toner resin. In the liquid developer, its electric capacitance does not significantly vary in an electric circuit where an electrical double-layer capacitor and an electronic resistance corresponding to a velocity of an electron exchange during an electrode reaction are connected in parallel, and a resistance corresponding to an electric conductivity of the insulating liquid is connected in series. The coloring agent has a coating layer so as to maintain distances between the toner fine particles. The insulating liquid has a viscosity of 0.5 mPa·s to 1000 mPa·s, a specific resistance of $1\times10^{12}$ Ωcm or more, and a surface tension of 30 dyn/cm or less, and may be a nonvolatile liquid having a boiling point of 100° C. or higher.

30 Claims, 14 Drawing Sheets

LIQUID DEVELOPER, IMAGE-FIXING APPARATUS USING THE SAME, AND IMAGE-FORMING APPARATUS USING THE SAME

BACKGROUND OF THE INVENTION

1. Field of the Invention

The present invention relates to a liquid developer suitable for use in electrostatic printing.

2. Description of the Related Art

"Electrostatic printing" is a term used to describe various non-impact printing methods, which enables forming a visible image by attracting charged particles for forming an image to charging sites on a substrate.

The charging site enables forming an electrostatic image, which may be referred to as a "latent image," thereon. The electrostatic image is formed temporarily retained in on a photoconductor or a pure dielectric. The electrostatic image may be visualized thereon, or may be transferred onto another substrate, and then visualized so as to develop.

Additionally, the charging site may be the reflection of those structured charges existing within a permanently polarized material, as is the case with ferroelectrics and other electrets.

Electrostatography encompasses those processes normally known as electrophotography and electrography.

In general, a liquid developer for electrostatography is prepared by dispersing an inorganic or organic coloring agent such as iron oxide, carbon black, nigrosine, phthalocyanine blue, benzidine yellow, quinacridone pink, and the like, into a liquid vehicle which may contain dissolved or dispersed therein synthetic or naturally occurring polymers such as acrylic resins, alkyd resins, rosins, rosin esters (ester gums), epoxy resins, poly(vinyl acetate), styrene-butadiene polymers, or the like.

Additionally, to generate or enhance the electrostatic charge on such dispersed polymer particles, additives known as charge directors or charge control agents may be included. Such materials can be metallic soaps, fatty acids, lecithin, organic phosphorus compounds, succinimides, sulphosuccinates, or the like.

In such liquid developers, whether positively or negatively charged, there is one ingredient of common generic character, namely a carrier liquid.

Since the beginning of the history of liquid toners, it has been recognized that certain electrical properties of the carrier liquid are mandatory requirements for the effective functioning of a conventional electrostatographic liquid development process.

These are low electrical conductivity and other requirements became obvious, such as the needs for low toxicity, increased fire safety, low solvent power, and low odor.

For these reasons, isoparaffinic-hydrocarbons such as the Isopar range manufactured by Exxon Mobile Corporation, the Shellsol range manufactured by Shell Chemical, Co., Ltd., and the Soltrol range manufactured by Phillips Petroleum, Co., Ltd. became the industrial standards for liquid toner carriers.

In more recent times, however, certain deficiencies in these isoparaffins have become apparent. Environmental concerns have given a liquid development process to reduce or eliminate volatile emissions, under increasing pressure. Flammability has also become important, regarding the more stringent transport regulations worldwide.

New designs of image fusing sites are exposed to increased importance on the thermal stability of carrier liquids.

In order to overcome these limitations and restrictions, it was found out that silicone fluids were the most effective materials that have the desirable properties of a carrier liquid for a liquid developer of past and current.

Silicone fluids have been mentioned in the context of liquid developers, for example, in the U.S. Pat. No. 3,105,821 of S. W. Johnson's, and the U.S. Pat. No. 3,053,688 of H. G. Greig's. Both of these early patents recognized the values and strength of silicone fluids. However, these two patents see the functions of the liquid developer relatively experimentally. These patents simply describe the mechanical dispersion of dry toners into the silicone fluid, with no regard to chemical compatibility. These patents in turn determine the final particle size and stability of the dispersion thus produced.

Recently, silicone fluids have again raised the attention, as disclosed in Japanese Patent Application Laid-Open (JP-A) No. 03-43749.

However, the JP-A No. 03-43749 discloses solely the mechanical dispersion. It does not state that the necessity of the mechanical dispersion for chemical compatibility, which is fairly established in a field of a developer, nor it states a charge control agent, which is the most important feature.

It is well known that silicone fluids is less soluble to plastics and that this property is well suited to prolong copy machine components and an organic photoconductor. This property produces an unfavorable result that a large number of polymers, which is usually utilized in a liquid developer, is insoluble in or incompatible to silicone, whether or not the polymers are controlled based on the U.S. Pat. No. 3,990,980 of G. Kosel et. al, or based on the U.S. Pat. No. 5,112,716 of Kato et. al, which is more recent application, or whether or not the polymers are chemically controlled based on an ordinary dispersion disclosed in the JP-A No. 03-43749.

Insolubility or incompatibility of the polymers causes a problem that the particle size and the stability of the dispersions thus prepared are limited and hence that it prevents reallogation of the dispersion because the polymers are not absorbed in the dispersed coloring agent after dissolved in silicone.

A demand has been made on a stable liquid developer that meets environmental requirements and enables image-forming properties such as color, tone, resolution, or the like. The JP-A No. 08-505709 and JP-A No. 08-505710 each disclose a liquid developer containing an unadulterated silicone as the carrier liquid.

SUMMARY OF THE INVENTION

The present inventors have focused on that toner fine particles containing a polymer which includes a coloring agent such as a pigment or dye dispersed in a carrier liquid decreases resistivity (specific resistance) as a weight concentration of the toner fine particles, whether or not the carrier liquid is volatile or nonvolatile.

Decrease in the resistivity occurs because the pigment or other substances in the toner fine particles work as an electronic conductive route.

The decrease in the resistivity is caused particularly by change in dispersion state and concentration of the solid of carrier liquid, during the procedures of electrostatography as the toner fine particles move and the carrier liquid decreases in amount.

This causes to prevent movement of the toner fine particles in an image-forming process by electrostatography.

Accordingly, an object of the present invention is to provide a liquid developer capable of keeping its high resistivity even when it has a high weight concentration of toner fine particles during or after an image-forming process using the liquid developer.

The present invention further provides, compared to conventional image-forming apparatuses, an image-fixing apparatus and an image-forming apparatus, both of which enable image-fixing at a high speed, while maintaining sufficient image-fixing properties at the same time.

The present invention further provides an image-forming apparatus that enables removing nonvolatile solvent in an image before fixing an image, and that improves image-fixing properties accordingly.

The present invention provides, in a first aspect, a liquid developer which comprises an insulating liquid and toner fine particles containing a coloring agent and a toner resin. In the liquid developer, the toner fine particles are dispersed in the insulating liquid, and the liquid developer has a specific resistance of $1\times10^6$ Ωcm or more, when a weight concentration of the toner fine particles in the liquid developer is 20% by weight or more, after the liquid developer is concentrated during image-forming.

The liquid developer of the present invention may have the specific resistance of $1\times10^6$ Ωcm or more, when the weight concentration of the toner fine particles in the liquid developer is 50% by weight or more.

The liquid developer of the present invention may have the specific resistance of $1\times10^6$ Ωcm or more, when the weight concentration of the toner fine particles in the liquid developer is 70% by weight or more.

The liquid developer of the present invention may have a dispersing agent which maintains distances among the toner fine particles.

In the liquid developer of the present invention, each of the toner fine particles may have at least one coating layer.

In the liquid developer of the present invention, the coloring agent may have at least one coating layer.

In the liquid developer of the present invention, the insulating liquid may have a viscosity of 0.5 mPa·s to 1000 mPa·s, a specific resistance of $1\times10^{12}$ Ωcm or more, and a surface tension of 30 dyn/cm or less.

In the liquid developer of the present invention, the insulating liquid may be a nonvolatile liquid in at least a portion thereof, and has a boiling point of 100° C. or higher.

In the liquid developer of the present invention, the insulating liquid may be a silicone solvent.

In the liquid developer of the present invention, the silicone solvent may be selected at least from phenylmethylsiloxane, dimethyl (poly)siloxane, and (poly) dimethyl cyclosiloxane.

In the liquid developer of the present invention, the insulating liquid may have a dispersing agent having a silicone group.

In the liquid developer of the present invention, each of the toner fine particles may have a silicone group on a surface thereof.

In the liquid developer of the present invention, each of the toner fine particles has a resin as a coating layer, and the resin has a lower glass transition temperature (Tg) than a glass transition temperature of the toner fine particles.

In the liquid developer of the present invention, the silicone group may dissociate from each of the toner fine particles, when the toner fine particles are heated during image-fixing.

In the liquid developer of the present invention, the insulating liquid forms an unfixed image, and the insulating liquid may ooze out of a surface of the unfixed image, when the unfixed image is heated during the image-forming.

In the liquid developer of the present invention, the insulating liquid may be a volatile liquid.

In the liquid developer of the present invention, the toner fine particles may have a volume average particle diameter of 0.1 μm to 6 μm, and a weight concentration of the toner fine particles in the liquid developer before the image-forming is 5% by weight to 40% by weight.

The present invention provides in a second aspect, a liquid developer which comprises an insulating liquid and toner fine particles containing a coloring agent and a toner resin. In the liquid developer, a rate of change of an electric capacitance of the liquid developer is 90% or less in an electric circuit where an electrical double-layer capacitor and an electronic resistance corresponding to a velocity of an electron exchange during an electrode reaction are connected in parallel, and a resistance corresponding to an electric conductivity of the insulating liquid is connected in series, when a weight concentration of the toner fine particles in the liquid developer varies from 20% by weight to 70% by weight during image-forming.

The present invention provides, in a third aspect, an image-fixing apparatus which comprises a solvent-oozer configured to heat a solvent of the liquid developer of the present invention which forms an unfixed image, so as to ooze the solvent out of a surface of the unfixed image, and a solvent-remover configured to remove the solvent on the surface of the unfixed image.

Herein, if the recording medium is made of a material that is likely to penetrate a solvent, like ordinary copy paper that has a rough surface, a certain degree of good image-fixing properties can be obtained, because the solvent, which has less viscosity because of heating, penetrates inside the copy paper. However, the toner image on the ordinary copy paper still has a residual solvent. Therefore, image-fixing properties for the ordinary copy paper was not perfect. A recording medium showing less penetration of the solvent, like PET film or surface-treated paper such as coated paper, art paper, or the like (including over head transparency or the like) show a considerable amount of the solvent inside the toner image. It showed very insufficient image-fixing properties.

The image-fixing apparatus of the present invention may further comprise a heat-fixer configured to heat the unfixed image, so as to fix the unfixed image onto the recording medium, after removing the solvent.

The present invention provides, in a fourth aspect, an image-forming apparatus which comprises a latent electrostatic image support configured to have a latent electrostatic image on a surface thereof, an image-developer configured to supply the liquid developer of the present invention onto the latent electrostatic image at a development nip part where the image-developer faces the latent electrostatic image support, so as to visualize the latent electrostatic image and to form a visible image, a transfer configured to transfer the visible image onto a recording medium at a transfer nip part where the latent electrostatic image support faces the recording medium, a fixer configured to fix the visible image on the recording medium at a fix nip part where the latent electrostatic image support faces a fixing roller, and one or more of removers configured to remove a solvent of the liquid developer from the visible image at one or both of between the development nip part and the transfer nip part, and between the transfer nip part and the fix nip part.

The image-forming apparatus of the present invention can provide the one in which the nonvolatile solvent can be sufficiently removed from the toner image prior to image-fixing, and which enables improving the image-fixing properties. However, it should be noted that the region where the solvent is removed includes nip parts on the both ends.

In the image-forming apparatus of the present invention, one or more of the removers are installed both of between the development nip part and the transfer nip part, and between the transfer nip part and the fix nip part.

In the image-forming apparatus of the present invention, the weight concentration of the toner fine particles in the liquid developer is 25% by weight or more at the fix nip part.

In the image-forming apparatus of the present invention, one or more of the removers are installed between the development nip part and the transfer nip part, and each of the removers is configured to have a removing member which faces the latent electrostatic image support, and removes the solvent of the liquid developer from the visible image, and a solvent-removing electric filed generator configured to generate a desirable electric filed between the latent electrostatic image support and the removing member, in which the desirable electric field attracts the liquid developer from a non-image part of the latent electrostatic image support to the removing member, and retains the toner fine particles on an image part of the latent electrostatic image support.

In the image-forming apparatus of the present invention, two or more of the removers are installed between the development nip part and the transfer nip part, an electric field of one of the removers attracts the liquid developer from the non-image part to a portion on the latent electrostatic image support closer to the removing member, and an electric field of one of the other removers retains the toner fine particles in the liquid developer on the image part, and attracts the solvent of the liquid developer to a portion on the latent electrostatic image support closer to the removing member.

The present invention provides, in a fifth aspect, an image-forming apparatus which comprises a latent electrostatic image support configured to have a latent electrostatic image on a surface thereof, an image-developer configured to supply the liquid developer of the present invention onto the latent electrostatic image at a development nip part where the image-developer faces the latent electrostatic image support, so as to visualize the latent electrostatic image and to form a visible image, a transfer configured to have a primary transfer which primarily transfers the visible image onto an intermediate transfer at a primary transfer nip part where the latent electrostatic image support faces the intermediate transfer, a secondary transfer which secondly transfers the visible image on the intermediate transfer onto a recording medium at a secondary transfer nip part where the intermediate transfer faces the recording medium, and a fixer configured to fix the visible image on the recording medium at a fix nip part where the latent electrostatic image support faces a fixing roller, and one or more of removers configured to remove a solvent of the liquid developer from the visible image at one or more of between the development nip part and the primary transfer nip part, between the primary transfer nip part and the secondary transfer nip part, and between the secondary transfer nip part and the fix nip part.

In the image-forming apparatus of the present invention, one or more of the removers are installed two or more of between the development nip part and the primary transfer nip part, between the primary transfer nip part and the secondary transfer nip part, and between the secondary transfer nip part and the fix nip part.

In the image-forming apparatus, the weight concentration of the toner fine particles in the liquid developer is 25% by weight or more at the fix nip part.

In the image-forming apparatus of the present invention, one or more of the removers are installed between the development nip part and the primary transfer nip part, and each of the removers is configured to have a removing member which faces the latent electrostatic image support, and removes the solvent of the liquid developer from the visible image, and a solvent-removing electric filed generator configured to generate a desirable electric filed between the latent electrostatic image support and the removing member, in which the desirable electric field attracts the liquid developer from a non-image part of the latent electrostatic image support to the removing member, and retains the toner fine particles on an image part of the latent electrostatic image support.

In the image-forming apparatus of the present invention, two or more of the removers are installed between the development nip part and the primary transfer nip part, an electric field of one of the removers attracts the liquid developer from the non-image part to a portion on the latent electrostatic image support closer to the removing member, and an electric field of one of the other removers retains the toner fine particles in the liquid developer on the image part, and attracts the solvent of the liquid developer to a portion on the latent electrostatic image support closer to the removing member.

DESCRIPTION OF THE PREFERRED EMBODIMENTS

The present invention will be illustrated in detail with reference to an embodiment, in which the liquid developer of the present invention is applied to an electrophotographic printer (hereinafter briefly may be referred to as "printer").

Figure 1:
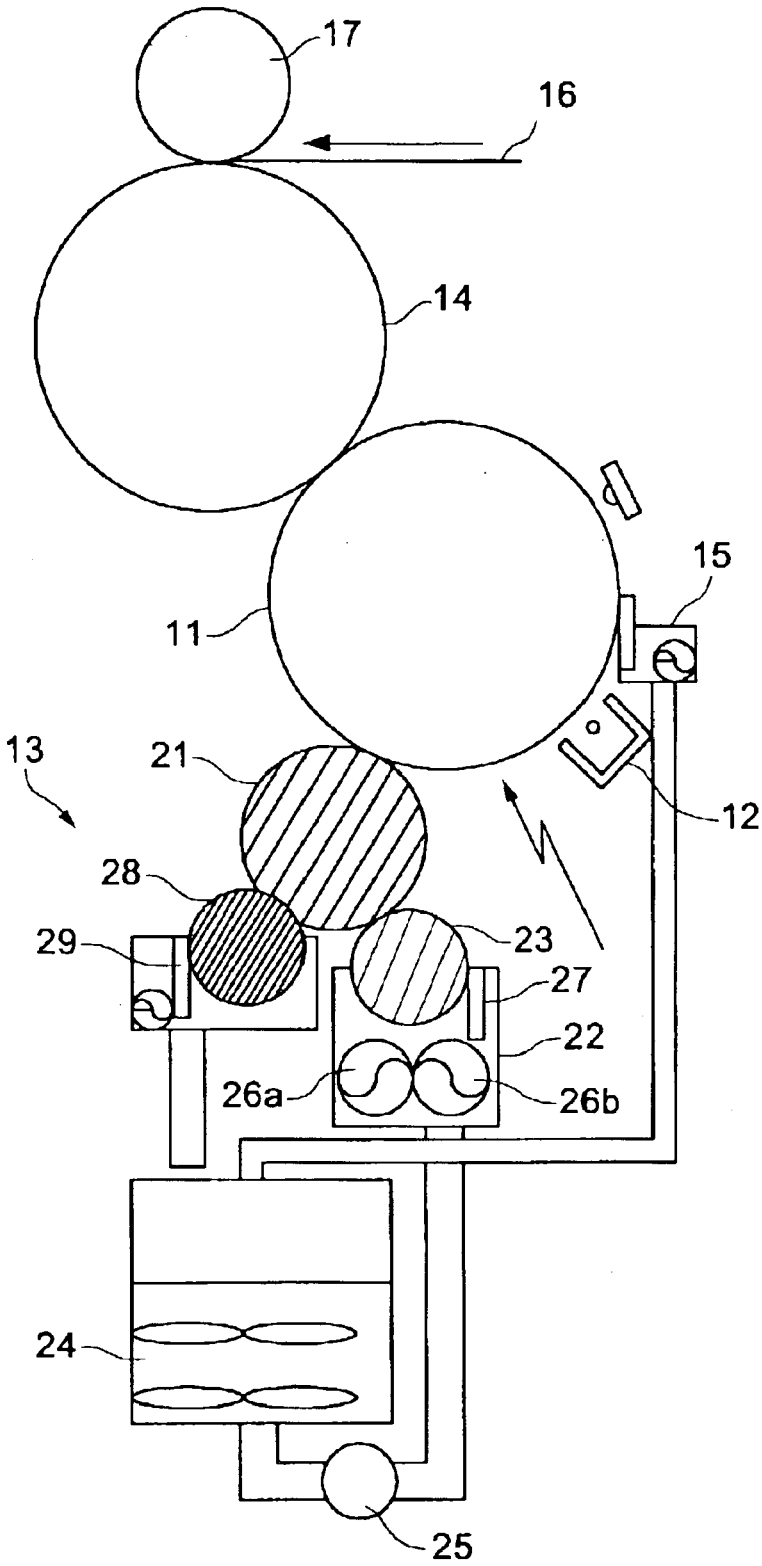
FIG. 1 is a schematic diagram showing an example of a printer using a liquid developer according to the present invention.

FIG. 1 is a schematic diagram showing an example of a printer using a liquid developer according to the present invention.

The printer includes a photoconductor drum 11 serving as a latent electrostatic image support. Arranged around the photoconductor drum 11 includes a charging unit 12, a developing unit 13, an intermediate transfer 14, and a photoconductor drum cleaning unit 15.

A transfer roller faces the intermediate transfer 14 and transfers an image formed on the intermediate transfer 14 to a recording paper 16.

The photoconductor drum 11 can be made of, for example, amorphous silicon (a-Si), an organic photoconductor (OPC), or the like.

A driving unit (not shown) such as a motor rotates and operates the photoconductor drum 11 at a constant speed during printing. The charging unit 12 uniformly charges the photoconductor drum 11, and an optical writing unit (not shown) irradiates a writing light to the photoconductor drum 11 based on image information. In this way, a latent electrostatic image is formed on the photoconductor drum 11.

A light-emitting diode (LED), a laser scanning optical system, or the like can be used as the optical writing unit.

In the printer, the liquid developer is used for forming a latent electrostatic image by optical writing and a photoconductor drum which serves as a latent electrostatic image support. The liquid developer of the present invention can also be applied to other image forming processes, such as an image forming process of a latent electrostatic image by ion flow using a dielectric drum.

The developing unit 13 develops the latent electrostatic image to thereby form a visible image on the photoconductor drum 11 serving as a latent electrostatic image support. The image formed on the photoconductor drum 11 is then transferred to the intermediate transfer 14, moving at the same speed as the photoconductor drum 11.

The recording paper 16 is transported from a feeder cassette (not shown), and the image on the intermediate transfer 14 is then transferred to the recording paper 16 by action of a transfer roller 17. After transfer, the transfer paper 16 is subjected to image-fixing by an image-fixing unit (not shown) and is ejected from the printer.

The liquid developer which has not been transferred to the intermediate transfer 14 and remains on the photoconductor drum 11 is removed from the photoconductor drum 11 by the photoconductor drum cleaning unit 15.

The liquid developer remained on the intermediate transfer 14 after transfer is removed by an intermediate transfer cleaning unit (not shown). Thereafter, residual potential on the surface of the photoconductor drum 11 is removed by a charging-eliminating lamp (not shown), so as to be subjected to another printing procedure.

The developing unit 13 includes a reservoir 22 to store the liquid developer, a coating roller 23 to apply the liquid developer to a developing roller 21, a pair of screws 26*a* and 26*b* for supplying the liquid developer to the coating roller 23, and a limiting blade 27 for controlling the amount of the liquid developer on the surface of the coating roller 23.

The reservoir 22 can store 100 cc to 150 cc of the liquid developer.

A transport pump 25 transports the liquid developer from a developer control unit 24 to the reservoir 22. The pair of screws 26*a* and 26*b* are operated to allow the level of the liquid developer in the reservoir 22 to rise, and the level, built-up part of the liquid developer, comes in contact with the coating roller 23 so as to supply the liquid developer to the coating roller 23.

The liquid developer supplied to the coating roller 23 is controlled by the limiting blade 27 and is applied to the developing roller 21 at a rate of about 30 cc per minute.

Excess of the liquid developer, if any, transported by the transport pump 25 is recovered into a developer recovery unit on the developing roller 21 and is recycled to the developer control unit 24. The developer recovery unit mainly comprises a sweep roller 28 and a cleaning blade 29 and serves to clean the residual liquid developer on the surface of the developing roller 21.

In conventional electrophotographic printers, the nip width between the photoconductor drum 11 serving as a latent electrostatic image support and the developing roller 21 (which may be referred to as a "development nip part," hereinafter) is set to be more than the product of the linear velocity of the associated roller and a time constant for development. The time constant for development refers to a period of time necessary for the amount of development to saturate and is produced by dividing the nip width (development nip part) by a process speed.

For example, assuming that the nip width (development nip part) is 3 mm and the process speed is 300 mm/sec, then the time constant for development is 10 msec.

According to the present invention, the time constant for development is preferably set to be smaller than the development time, and the liquid developer in non-image portions that have not been developed on the photoconductor drum 11 is recovered by the developer recovery unit of the developing roller 21 without agglomeration.

The liquid developer of the present invention can maintain its specific resistance of $1\times10^6$ Ωcm or more, even when a weight concentration of the toner fine particles in the liquid developer varies from 20% by weight to 70% by weight in the developed portion of the developing roller 21. Thus, the toner fine particles can move or migrate without decreasing latent image potential.

In addition, an electric capacitance of the liquid developer of the present invention does not significantly vary in an electric circuit where an electrical double-layer capacitor of the liquid developer is connected in parallel to an electronic resistance corresponding to a velocity of an electron exchange during an electrode reaction, and a resistance corresponding to an electric conductivity of the insulating liquid of is connected in series to the electrical double-layer capacitor, when a weight concentration of the toner fine particles in the liquid developer varies from 20% by weight to 70% by weight during an image-forming process. Here, the above sentence, "an electric capacitance of the liquid developer of the present invention does not significantly vary," refers to, as shown in Table 4, a situation where the electric capacitance cannot be measured, subjecting to the initial value. The specific rate of change of the electric capacitance is 90% or less, and more preferably 50% or less.

By suppressing significant variation in the electric capacity, the liquid developer has excellent durability with less charge injection from electrodes.

The liquid developer comprises an insulating liquid and toner fine particles containing a coloring agent and a resin. Here, the toner fine particles are dispersed in the insulating liquid. The aforementioned liquid developer capable of allowing the toner fine particles to electrostatically move and capable of maintaining its high resistance even at a high weight concentration of the toner fine particles can be obtained by avoiding the formation of a conductive path. The formation of a conductive path can be avoided by incorporating a dispersing agent in the liquid developer to thereby maintain the distances among the dispersed toner fine particles, by forming at least one coating layer on the coloring agent or on the toner fine particles, or by using these two methods in combination.

The toner fine particles or the coloring agent for use in the liquid developer of the present invention is preferably subjected to surface modification by forming at least one coating layer on its surface with an insulating material. This procedure is to prevent the presence of conductive particles on the outer periphery of the toner fine particles when a pigment having a low electric resistance such as carbon black, is used as the coloring agent. Thus, the formation of an electrically conductive path accompanied with the movement and compression of the toner fine particles can be prevented, and thereby the variation in resistivity of the liquid developer can be prevented.

Both the use of the dispersing agent to have a physical distance among the toner fine particles and the formation of the coating layer on the toner fine particles or on the coloring agent can produce similar advantages to the liquid developer. Employing both the use and the formation together can further contribute to these advantages.

Such a surface modifier is required to have low compatibility or miscibility with the toner resin, which is an insulating resin, from a viewpoint of dispersing the surface modifier into the toner resin.

The surface modifier is added so as to form an electric barrier, and the surface modifier is required to comprise materials having different compatibility from the toner resin.

Examples of the surface modifier for use in the coating layer include conventional surface modifiers such as a silane coupling agent, a titanium coupling agent, an aluminium coupling agent, and the like.

Examples of the silane coupling agent include alkoxysilanes such as methyltrimethoxysilane, phenyltrimethoxysilane, methylphenyldimethoxysilane, diphehyldimethoxysilane, or the like; siloxanes such as hexamethyldisiloxane, or the like; γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, γ-ureidopropyltriethoxysilane, and the like.

The amount of the surface modifier is preferably from 0.01% by weight to 20% by weight, and more preferably from 0.1% by weight to 5% by weight relative to the weight of the pigment.

The toner fine particles can be modified on their surfaces by, for example, adding the surface modifier to a dispersion including the toner fine particles, and then allowing the two components to react with each other by heating. The surface-modified toner fine particles are recovered by filtering, are subjected to repeated washing and filtering procedures using the same solvent, and then are dried.

The charge of the toner fine particles in the liquid may be controlled by using dispersing substances (organic materials), pigments and metallic soaps, all of which are utilized in the toner fine particles.

When a hydrocarbon solvent is used as a dispersion medium (carrier), a particle composition, which is insoluble in a hydrocarbon solvent, and a polymer with high solubility in a hydrocarbon solvent may be used as the toner fine particles, resulting in improved dispersibility and charge control.

The polymers in the present invention are copolymers of monomers that have good affinity for a hydrocarbon solvent, of acrylic monomers with a (poly)oxyalkylene group, of monomers with acidic groups and bases, and of monomers with polar groups according to necessity. Hereinafter, monomers that enable polymerization in the present invention will be further described.

When the polymers consisting of the monomers are monopolymers, aforementioned monomers that have good affinity for hydrocarbon solvents provide polymers soluble in hydrocarbon solvents, resulting in a stable dispersion with good affinity for hydrocarbon solvents, even in the case of copolymers with other monomers whether soluble or insoluble.

Examples of the monomers include 2-ethylhexyl(meth)acrylate, octyl(meth)acrylate, nonyl(meth)acrylate, decyl(meth)acrylate, lauryl(meth)acrylate, stearyl(meth)acrylate, vinyllaurate, laurylmethacrylamide, stearylmethacrylamide, methoxyethyl(meth)acrylate, ethoxyethyl(meth)acrylate, butoxyethyl(meth)acrylate, methyl(meth)acrylate, ethyl(meth)acrylate, butyl(meth)acrylate, hexyl(meth)acrylate, cyclohexyl(meth)acrylate, benzyl(meth)acrylate, phenyl(meth)acrylate styrene, vinyltoluen, vinyl acetate, and the like.

The aforementioned copolymer having acrylic monomers with a (poly)oxyalkylene group adsorbs insoluble particles within the solvent, which contributes stabilizing the dispersion of the toner fine particles because of the steric effect of the polyethylene glycol chain.

Above-mentioned monomers which enables copolymerization are as follows.

(a) Examples of the monomers including acid groups: Those monomers have a vinyl group and at least one selected from —COOH group, —$SO_3H$ group, —$SO_2H$ group, —$CH_2NO_2$ group, —$CHRNO_2$ group, —ArOH group, and —ArSH group (herein, R expresses alkyl group, and Ar expresses allyl group). Specific examples include (meth) acrylic acid, maleic acid, maleic anhydride, itaconic acid, itaconic acid anhydride, fumaric acid, cinnamic acid, crotonic acid, vinylbenzoic acid, 2-methacryloxyethyl succinic acid, 2-methacryloxyethyl maleate, 2-methacryloxyetylhexahydrophthalate, vinyl sulfonate, allyl sulfonate, styrene sulfonate, 2-sulfoethylmethacrylate, 2-acrylamide-2-methylpropane sulfonate, 3-chloroamidephosphoxypropylmethacrylate, 2-methacryloxyethyl acidphosphate, and the like.

(b) Examples of the monomer including base: Those monomers have a vinyl group and at least one selected from —$NH_2$ group, —NHR group, —NRR' group, pyridyl group, and piperidyl group (herein, R expresses alkyl group, and R' expresses allyl group). Specific examples include N-methylaminoethyl(meth) acrylate, N-ethylaminoethyl (meth)acrylate, N,N-dimethylaminoethyl(meth)acrylate, N,N-diethylaminoethyl(meth)acrylate, N,N-dibutylaminoethylacrylate, N-phenylaminoethylmethacrylate, N,N-diphenylaminoethylmethacrylate, aminostyren, dimethyl aminostyren, N-methylaminoethylstyren, dimethylamino ethoxy styrene, diphenylaminoethylstyren, N-phenylaminoethylstyren, 2-N-piperidylethyl(meth) acrylate, 2-vinylpyridine, 4-vinylpyridine, 2-vinyl-6-methylpyridine, and the like.

(c) Examples of the monomer including polar groups: 2-hydroxyethyl(meth)acrylate, 2,3-dihydroxypropyl(meth) acrylate, 4-hydroxybutyl(meth)acrylate, 2-hydroxy-3-propylmethacrylate, 2-chloroethyl(meth)acrylate, 2,3-dibromopropyl(meth)acrylate, (meth)acrylonitrile, isobutyl-2-cyanoacrylate, 2-cyanoethylacrylate, ethyl-2-cyanoacrylate, methacrylacetone, vinylpyrrolidone, N-acryloylmorpholine, tetrahydrofurofurfurylmethacrylate, trifluoroethylmethacrylate, p-nitrostyrene, acrylamide, methacrylamide, N,N-dimethylmethacrylamide, N,N-dibutylmethacrylamide, and the like.

(d) Examples of the polyfunctional monomers: divinyl benzene, ethylene glycol di(meth)acrylate, diethylene glycol di(meth)acrylate, triethylene glycol tri(meth)acrylate, butanediol di(meth)acrylate, 1,6-hexanediol di(meth) acrylate, trimethylolpropane tri(meth)acrylate, tetramethylolmethan tri(meth)acrylate, tetramethylolmethane tetra (meth)acrylate, dipropylene glycol di(meth)acrylate, trimethylolhexane tri(meth)acrylate, pentaerythrit tetra (meth)acrylate, 1,3-dibutylene glycol di(meth)acrylate, trimethylolethanetri(meth)acrylate, and the like.

A copolymer having monomers with good affinity for a hydrocarbon solvent and monomers with a (poly) oxyalkylene group, is used as a polymer in one embodiment (A) of the present invention. Moreover, in this case, the following materials are used as an insoluble toner fine particles in a hydrocarbon solvent; various insoluble resins, conventional inorganic or organic pigments, metal, metallic oxide, magnetic particles, wax-like materials (for instance, low molecular weight polyolefin and wax), chemical products (for instance, pesticides), and foaming agents.

More specifically, one or a mixture of well-known conventional dyes and pigments can be used. Specific examples include carbon black, lamp black, ultramarine blue, aniline blue, phthalocyanine blue, phthalocyanine green, hansa yellow G, rhodamine 6G, lake, chalcoil blue, chrome yellow, quinacridone, benzidine yellow, rose bengal, triarylmethane dye and the like. The specific examples also include iron oxide such as magnetite, hematite, ferrite, or the like; metals such as iron, carbonyl iron powder, cobalt, nickel, or the like; and metallic alloys and mixtures of above-mentioned metals and other metals such as aluminum, cobalt, copper, lead, magnesium, tin, zinc, antimony, beryllium, bismuth, cadmium, calcium, manganese, selenium, titanium, tungsten, vanadium, or the like. Glass beads may also be used. The following styrene block copolymers are used as the resin; monopolymers of styrene and substituents such as polystyrene, poly p-chlorostyrene, polyvinyl toluene, or the like; styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methylmethacrylate copolymer, styrene-ethyl methacrylate copolymer, styrene-bythylmethacrylate copolymer, styrene-α-chloromethacrylate copolymer, styrene-acrylonitrile copolymer, styrene-vinylmethylether copolymer, styrene-vinyl ethylether copolymer, styrene-vinylmethylketone copolymer, styrene-butadiene copolymer, styrene-isoprene copolymer, styrene-acrylonitrile-indene copolymer, styrene-maleic acid copolymer, styrene-maleate copolymer, and the like.

Additionally, copolymers comprising monomers with good affinity for hydrocarbon solvent and monomers mentioned in (d) are also used. In this case, however, predetermining a specific ratio of these monomers is very difficult. The desired insoluble resins will be obtained based upon experience. The most positive way to obtain an insoluble resin is to use relatively large amounts of the monomers mentioned in (d).

Moreover, depending on use, the dispersion and the dispersion may be colored by adding a hydrocarbon solvent soluble dye to the dispersion or by making a chemical bond with a dispersion of the present invention.

A copolymer comprising monomers with good affinity for a hydrocarbon solvent, monomers expressed by the (poly) oxylene group, and previously mentioned (a) monomers, is used as a polymer in another Example (B) of the present invention. In this case, the particle components used in the above-mentioned Example (A) can be used as the insoluble particle component in a hydrocarbon solvent of the present invention.

A copolymer comprising monomers with good affinity for a hydrocarbon solvent, monomers expressed by the (poly) oxylene group, and monomers of previously mentioned (b), is used as a polymer in another Example (C) of the present invention.

In this case, the particle components used in the above-mentioned Example (A) can be used as the insoluble particle component in a hydrocarbon solvent.

A polymer used in the above-mentioned Example (B) can be used in a further Example (D) of the present invention. Additionally, as insoluble particle component in the hydrocarbon solvent in this case, a hydrocarbon solvent insoluble resin, including the monomer of previously mentioned (b), can be used as the binder of the insoluble particle component in the above-mentioned Example (A). Moreover, when materials such as carbon black and metallic oxides that can combine with the monomers by grafting are used as solid particles, bases may be combined with the monomers by reacting the monomers described in (b) with those materials.

A polymer used in the above-mentioned Example (B) can be used in a further Example (E) of the present invention. Additionally, as insoluble particle component in the hydrocarbon solvent in this case, a hydrocarbon solvent insoluble resin, including the monomers of previously mentioned (b) and (c) can be used as the binder of the insoluble particle component in the above-mentioned Example (A). Moreover, when materials such as carbon black and metallic oxides that can be bonded to the monomers by grafting are used as solid particles, bases and polar groups may be combined with the monomers by reacting the monomers described in (b) and (c) with those materials.

A copolymer comprising monomers compatible with a hydrocarbon solvent, monomers expressed by (poly)oxylene group, and monomers previously mentioned (a) and (c) can be used in a further Example (F) of the present invention. In this case, the particle components used in the above-mentioned Example (D) can be used as insoluble particle component in the hydrocarbon solvent.

A copolymer used in the above-mentioned Example (F) can be used in a further Example (G) of the present invention. In this case, the particle components used in the above-mentioned Example (E) can be used as insoluble particle component in the hydrocarbon solvent.

A copolymer used in the above-mentioned Example (C) can be used in a further Example (H) of the present invention. Additionally, as insoluble particle component in the hydrocarbon solvent in this case, a hydrocarbon solvent insoluble resin, including the monomers of previously mentioned (a), can be used as the binder of the insoluble particle component in the above-mentioned Example (A). Moreover, when materials such as carbon black and metallic oxides that can be bonded to the monomers by grafting are used as solid particles, bases may be combined with the monomers by reacting the monomers described in (a) with those materials.

A copolymer used in the above-mentioned Example (C) can be used in a further Example (I) of the present invention. Additionally, as insoluble particle component in the hydrocarbon solvent in this case, a hydrocarbon solvent insoluble resin, including the monomers of previously mentioned (a) and (c), can be used as the binder of the insoluble particle component in the above-mentioned Example (A). Moreover, when materials such as carbon black and metallic oxides that can be bonded to the monomers by grafting are used as solid particles, bases and polar groups may be combined by reacting the monomers described in (a) and (c) with those materials.

A copolymer comprising monomers compatible with a hydrocarbon solvent, monomers expressed by (poly)oxylene group, and monomers previously mentioned (b) and (c) can be used in a further Example (J) of the present invention. In this case, the particle components used in the above-mentioned Example (H) can be used as insoluble particle component in the hydrocarbon solvent.

A copolymer used in the above-mentioned Example (j) can be used in a further Example (K) of the present invention. In this case, the particle components used in the above-mentioned Example (I) can be used as insoluble particle component in the hydrocarbon solvent.

In the case of the Example (A), the dispersion in the present invention may be produced only by mixing and dispersing each of the resin component and the solid particles into the hydrocarbon solvent. In this case, ball mills, sand mills, and attrition mills may be used for dispersion. However, it is to be understood that the order of mixing is not intended to be limited.

An excellent dispersion stability is obtained when the viscosity of the hydrocarbon solvent used as the dispersion medium in the present invention is 1000 cSt (centistokes) or less, preferably 200 cSt or less. Although the reason for obtaining the excellent dispersion stability has not become clear, it is assumed that the molecular weight of the oil increases with increasing viscosity of the hydrocarbon solvent, resulting in a decrease in the solubility of the resins used in the present invention or perhaps in the affinity between the resins and the oil.

In the liquid developer of the present invention, which contains both insoluble particle components and soluble resins in the solvent, the hydrocarbon solvent soluble resins adsorb on the insoluble particles, resulting in a stable dispersion because of the steric effect of the particles.

Additionally, in the dispersion of the present invention, the particles absorbing the resins that are soluble in the hydrocarbon solvent enable control over the positive charge polarity because the resins soluble in the hydrocarbon solvent have acid groups but no bases. In this case, the electrostatic repulsion increases the dispersion stability.

Moreover, in the dispersion of the present invention, the particles adsorbing the resins that are soluble in the hydrocarbon solvent enable control over the negative charge polarity because the resins soluble in the hydrocarbon solvent has bases but no acid groups. In this case, the electrostatic repulsion increases the dispersion stability.

In the dispersion of the present invention, the hydrocarbon solvent soluble resins, having additional nonionic polar constituents, enhance charge formation due to the solvation of acid and base, resulting in increased dispersion stability.

Moreover, in the dispersion of the present invention, the particles enable control over the negative charge polarity due to the particles having acid groups and no bases on the surface, resulting in increased dispersion stability by electrostatic repulsion.

In the dispersion of the present invention, the particles enable control over the positive charge polarity due to the particles having bases and no acid groups on the surface, resulting in increased dispersion stability by electrostatic repulsion.

In the dispersion of the present invention, the resins, particles having additional nonionic polar constituents on the surface, enhance charge formation due to the solvation of acid and basic, resulting in increased dispersion stability.

In the dispersion of the present invention, charge is generated by the acid-basic dissociation between the particle surface and the adsorbed resins when the particles have acid groups but no bases on the surface and the hydrocarbon solvent soluble resins have bases and no acid groups, and/or the particles have bases and no acid groups on the surface and the hydrocarbon solvent soluble resins have acid groups but no bases. At the same time, the adsorbed resins provide the steric effect and the synergistic effect of dispersion stability, thereby obtaining a dispersion liquid enhanced with long-term stability and quick response electrophoretic properties.

When a silicone family solvent is used for the dispersion (carrier), it may be possible to improve the dispersibility and to control charging because the polymers having one-end degenerated silicone monomer units with reactive organic groups are included as the toner fine particles.

The one-end degenerated silicone monomer units with reactive organic groups has strong affinity for silicone oil and a regular silicone polymer has poor solubility in silicone oil. However, polymers consisting of such monomers provide soluble polymers in silicone oil in the case of monopolymers, and provide copolymers with good affinity whether the copolymers are soluble or not with other monomers. Therefore, a stable dispersion is obtained in the system.

The followings are the examples of the monomers which can make copolymers with the aforementioned one-end degenerated silicone monomer that has reactive organic groups.

(s1) monomers having acid groups: (meth) acrylic acid, maleic acid, maleic anhydride, itaconic acid, itaconic acid anhydride, fumaric acid, cinnamic acid, crotonic acid, vinylbenzoic acid, 2-methacryloxyethyl succinic acid, 2-methacryloxyethyl maleate, 2-methacryloxyethylhexahydrophthalate, 2-methacryloxyethyltrimellitic acid, vinyl sulfonate, allyl sulfonate, styrene sulfonate, 2-sulfoethylmethacrylate, 2-acrylamide-2-methylpropane sulfonate, 3-chloroamidephosphoxypropylmethacrylate, 2-methacryloxyethyl acidphosphate, hydroxystyrene, and the like.

(s2) monomers having bases: N-methylaminoethyl(meth) acrylate, N-ethylaminoethyl(meth)acrylate, N,N-dimethylaminoethyl(meth)acrylate, N,N-diethylaminoethyl (meth)acrylate, N,N-dibutylaminoethylacrylate, N-phenylaminoethylmethacrylate, N,N-diphenylaminoethylmethacrylate, amino styrene, dimethyl amino styrene, N-methylaminoethylstyren, dimethylamino ethoxy styrene, diphenylaminoethylstyrene, N-phenylaminoethylstyrene, vinylpyrrolidone, 2-N-piperidylethyl(meth)acrylate, 2-vinylpyridine, 4-vinylpyridine, 2-vinyl-6-methylpyridine, acrylamide, methacrylamide, N,N-dimethylmethacrylamide, N,N-dibutylmethacrylamide, and the like.

(s3) monomers having polar group: 2-hydroxyethyl(meth) acrylate, 2,3-dihydroxypropyl(meth)acrylate, 4-hydroxybutyl(meth)acrylate, 2-hydroxy-3-propylmethacrylate, 2-chloroethyl(meth) acrylate, 2,3-dibromopropyl(meth)acrylate, (meth)acrylonitrile, isobutyl-2-cyanoacrylate, 2-cyanoethylacrylate, ethyl-2-cyanoacrylate, methacrylacetone, tetrahydrofurofurfurylmethacrylate, trifluoroethylmethacrylate, p-nitrostyrene, and the like.

(s4) the polyfunctional monomers: divinyl benzene, ethylene glycoldi(meth)acrylate, diethylene glycoldi(meth) acrylate, triethylene glycoltri(meth)acrylate, butanedioldi (meth)acrylate, 1,6-hexanedioldi(meth)acrylate, trimethylolpropanetri(meth)acrylate, tetramethylolmethantri (meth) acrylate tetramethylolmethanetetra(meth)acrylate, dipropylene glycoldi(meth)acrylate, trimethylolhexanetri (meth)acrylate, pentaerythrittetra(meth)acrylate, 1,3-dibutylene glycoldi(meth)acrylate, trimethylolethanetri (meth)acrylate, and the like.

(s5) other monomers: 2-ethylhexyl(meth)acrylate, octyl (meth)acrylate, nonyl(meth)acrylate, decyl(meth)acrylate, lauryl(meth)acrylate, stearyl(meth)acrylate, vinyllaurate, lauryl methacrylamide, stearyl methacrylamide, methoxyethyl(meth)acrylate, ethoxyethyl(meth)acrylate, butoxyethyl(meth)acrylate, methyl(meth)acrylate, ethyl (meth)acrylate, buthyl(meth)acrylate, hexyl(meth)acrylate, cyclohexyl(meth)acrylate, benzil(meth)acrylate, phenyl (meth)acrylate, styrene, vinyltoluene, vinyl acetate, and the like.

The copolymers of aforementioned one-end degenerated silicone monomers with reactive organic groups and monomers of (s1) to (s5) are given as polymers including one-end degenerated silicone monomer units with reactive organic groups. The copolymers of one-end degenerated silicone monomers with at least reactive organic groups and monomers having polar groups (s3) are given as copolymers of one-end degenerated silicone monomers with reactive organic groups and monomers with polar groups. Additionally, the copolymers of one-end degenerated silicone monomers with at least reactive organic groups and monomers having acid groups (s1) are given as copolymers of one-end degenerated silicone monomers with reactive organic groups and monomers with acid groups. Moreover, the copolymers of one-end degenerated silicone monomers with at least reactive organic groups and monomers having bases (s2) are given as copolymers of one-end degenerated silicone monomers with reactive organic groups and monomers with bases. The copolymers of one-end degenerated silicone monomers with at least reactive organic groups and monomers of aforementioned (s1) to (s5) are given as insoluble polymers having the one-end degenerated silicone monomers with reactive organic groups in silicone oil. In this case, however, predetermining a specific ratio of these monomers, and the desired insoluble resins will be obtained based on experience. This is due to a property of silicone oil, poor solubility. In order to obtain an insoluble resin, the most reliable way is to use relatively large amounts of the monomers mentioned in (s4).

Controlling the amount of charge in both hydrocarbon and silicone is achieved in the following manners; the surface of the particles comprising the above-mentioned materials is measured in a non-polar solvent to know whether it is acid or basic, and then these materials are combined according to the conditions so as to give either a positive or negative charge.

Examples of charge control agents include dialkyl sulfosuccinic acid metallic salts such as cobalt dialkyl sulfonsuccinate, manganese dialkyl sulfosuccinate, zirconium dialkyl sulfosuccinate, yttrium dialkyl sulfosuccinate, nickel dialkyl sulfosuccinate, or the like; metallic soaps such as manganese naphthenate, calcium naphthenate, zirconium naphthenate, cobalt naphthenate, iron naphthenate, lead naphthenate, nickel naphthenate, chromium naphthenate, zinc naphthenate, magnesium naphthenate, manganese octylate, calcium octylate, zirconium octylate, iron octylate, lead octylate, cobalt octylate, chromium octylate, zinc octylate, magnesium octylate, manganese dodecylate, calcium dodecylate, zirconium dodecylate, iron dodecylate, lead dodecylate, cobalt dodecylate, chromium dodecylate, zinc dodecylate, magnesium dodecylate, or the like; metal alkylbenzene sulfonates such as calcium dodecylbenzenesulfonate, sodium dodecylbenzenesulfonate, barium dodecylbenzenesulfonate, or the like; lipid phosphides such as lecithin, separin, or the like; organic amines such as n-decylamine, or the like.

The amount of the charge control agents may be the minimum value to obtain charge control, and the relative amount of charge control agents to be added to the liquid developer is usually 0.01% by weight to 50% by weight.

Although the charge control agents exhibit effective charge control properties by adding any treatment steps described later or after removing the solvent, granulation should be carried out preferably in the presence of the charge control agent.

For instance, in the treatment steps described later, it is added in other materials, solvents, or intermediate products in a step prior to the treatment steps, and then the solution of resins or the varnish and the electric insulating dispersion medium are mixed with coloring agent and charge control agents.

The liquid developer of the present invention has a high viscosity and a high concentration. The insulating liquid, which is included in the liquid developer, should preferably have a viscosity of 0.5 mPa·s or more and 1000 mPa·s or less.

When the insulating liquid has a viscosity of 0.5 mPa·s as the lower limit, the liquid developer may avoid image-fixing offset. When it has a viscosity of 1000 mPa·s as the upper limit, the absorption and adhesion of the insulating liquid to a transfer sheet (transfer paper) may be minimized.

The insulating liquid preferably has a specific resistance of $1\times10^{12}$ Ωcm or more. When the insulating liquid has a specific resistance of $10^{12}$ Ωcm as the lower limit, deterioration in insulation properties and problems in conductivity of the toner due to a low specific resistance can be avoided. Accordingly, stable charging properties can be obtained.

The insulating liquid preferably has a surface tension of 30 dyn/cm or less. By this configuration, wettability due to a larger surface tension can be avoided. Accordingly, high image quality can be maintained without problems.

In addition, the insulating liquid preferably has a boiling point of 100° C. or higher. Evaporation of the liquid developer may cause various disadvantages. Thus, the insulating liquid should preferably have a high boiling point to allow the liquid developer to be nonvolatile in normal operation temperatures lower than the boiling point of water.

The carrier liquid for use as the insulating liquid in the liquid developer has a high flash point as its thermal properties and a high resistance as its electric properties and includes dispersed toner fine particles comprising an insulating resin (hereinafter may be referred to as "toner resin") and a coloring agent. Highly insulating substances such as silicone oil, normal paraffins, Isopar, vegetable oil, mineral oil, and the like are preferred as the carrier liquid. However, the carrier liquid is not specifically limited as long as it is electrically insulating.

The volatility or the nonvolatility of the carrier liquid can be selected according to the intended purpose. When a volatile insulating liquid is used as the carrier liquid, the carrier liquid evaporates during the process and the liquid developer has a high concentration of the toner fine particles. When a nonvolatile insulating liquid is used as the carrier liquid, the amount of the carrier liquid must be reduced as low as possible to prevent deterioration of image-fixing properties due to the interposition of the carrier liquid and to form images with high quality at a high speed. In such a small amount of the carrier liquid, the weight concentration of the toner fine particles is increased in portions where solids are concentrated. In any case, the resulting liquid developer has a high weight concentration of the toner fine particles, since the amount of the carrier liquid is reduced during such an image forming process.

By using a silicone solvent having a higher resistance than Isopar as the carrier liquid, the toner fine particles can keep their satisfactory charging properties even in the high weight concentration of the toner fine particles.

When Isopar is used as the carrier liquid, the toner fine particles may have better dispersibility, since resins generally have affinity for such hydrocarbon solvents. This is effective for dispersion of a toner in a conventional weight concentration of the toner fine particles (5% or less). However, the viscosity increases with an increase in a weight concentration of the toner fine particles, because of high affinity between the resin and the Isopar. In addition, the high affinity invites exposure of the pigment component to the dispersion medium and decrease in electric insulating properties due to decreased distance among the particles. To keep insulation, a long-chain polymer may be used as the dispersing medium, but this invites a further increased viscosity.

In a liquid developer containing toner fine particles in a high weight concentration as in the present embodiment, the toner fine particles are compacted and are uniformly dispersed even in such a silicone carrier liquid.

Such silicone oil is a chemically synthesized product and has stable properties, is nonvolatile and is not fixed or attached even when used in a movable portion. The silicone oil can therefore avoid pollution due to evaporation of the carrier liquid and fixation of the liquid developer to a movable portion by applying stress loading to the liquid developer.

The use of such a silicone carrier liquid effectively improve the operation environment in the production and use of the liquid developer, can simplify applying the stress loading and can reduce the frequency of maintenance of the apparatus.

Carrier liquids for use in the liquid developer of the present invention include, but are not limited to, aliphatic hydrocarbon solutions such as cyclohexane, n-hexane, n-heptane, n-octane, n-nonane, isooctane, and isododecane; petroleum hydrocarbons such as ligroin, and mixtures thereof (commercially available under the trade names of Isopar E, G, H, L, K, and V, and Solvesso 150 from Exxon Mobile Corporation, and Shellsol 71 or the like from Shell Chemicals).

Examples of the silicone solvents include alkyl silicone oil, cyclic polydialkylsiloxane or cyclic polyalkylphenylsiloxane, alkylphenylsiloxane, and the like. The examples also include higher fatty acid modified silicone oil, methyl chlorinated phenyl silicone oil, alkyl modified silicone oil, methyl hydrogen silicone oil, amino-modified silicone oil, epoxy-modified silicone oil, and the like.

Moreover, when cyclic polydialkylsiloxane or cyclic polyalkylphenylsiloxane are used, there is an advantage of improved resin coating properties and coated film luster because the obtained resins have the drying properties of a polymerized solvent. When alkylphenylsiloxane is used, especially preferred is methylphenyl silicone oil. There is the advantage of improved dispersion stability of the resin solvent because of improved solubility by the introduction of 5% by mole to 50% by mole of phenyl groups. Examples of silicone oils are given as follows.

(i) Dialkyl Silicone Oil

Examples of the dialkyl silicone oil include dimethyl silicone, diethyl silicone, dibutyl silicone, dihjexyl silicone, dilauryl silicone, distearyl silicone, and the like.

(ii) Cyclic polydialkylsiloxane and cyclic polyalkylphenylsiloxane, which includes the phenyl groups of 5% by mole, 10% by mole, 20% by mole, and 50% by mole: cyclic polydimethylsiloxane, cyclic polymethylphenylsiloxane, cyclic polydiethylsiloxane, cyclic polyethylphenylsiloxane, cyclic polydibutylsiloxane, cyclic polybutylsiloxane, cyclic polybutylphenylsiloxane, cyclic polydihexylsiloxane, cyclic polyhexylphenylsiloxane, cyclic polydilaurylsiloxane, cyclic polymethylchlorophenylsiloxane, cyclic polydistearylsiloxane, cyclic polymethylbromphenylsiloxane, and the like.

(iii) Alkylphenyl Silicone Oil

Examples of the alkylpheynyl silicone oil include methylphenyl silicone, ethylphenylsilicone, proprylphenyl silicone, butylphenyl silicone, hexylphenyl silicone, octylphenyl silicone, lauryl phenyl silicone, stearyl phenyl silicone, and the like.

Commercially available silicone oil, which include KF-96L [0.65, 1.0, 1.5, 2.0 centistokes], KF-96 [10, 20, 30, 50, 500, 1000, 3000], KF-56, KF-58, KF-54, and the like from Shin-Etsu Chemical Industry Ltd., and TSF451 series, TSF456 series, TSF410, 411, 440, 4420, 484, 483, 431, 433 series, THF450 series, TSF404, 405, 406, 451-5A, 451-10A, 437 series, TSF440, 400, 401, 4300, 4445, 4700, 4450, 4702, 4730 series, and TSF434, 4600 series from Toshiba Silicone Ltd. Moreover, HS-200 from TORAY Silicone, Inc. may also be included. These may be used in a suitable combination of two or more.

The above-described silicone oil may be mixed with other solvents to the extent that the properties of the silicone oil are not diminished. Examples of the solvent include the aromatic hydrocarbon solvents such as toluene, xylene, benzene, or the like; ethers; esters; alcohol solvents; aliphatic hydrocarbon such as n-hexane, n-octane, iso-octane, iso-dodecane, mixtures thereof, or the like (for example, commercially available Isopar H.G.L.V from the Exxon Chemical, Inc). The mixture ratio of other solvents is about 0.1 part by mass to 500 parts by mass to 100 parts by mass of silicone oil.

These may be used in a suitable combination of two or more.

The toner resin for use in the liquid developer comprises a coloring agent and constitutes the toner fine particles.

Such toner resins include, but are not limited to, synthetic or naturally occurring polymers such as an acrylic resin, an alkyd resin, a rosin, a rosin ester (ester gum), an epoxy resin, a polyester, a styrene-butadiene polymers, and the like. Each of these polymers can be used as a starting monomer or as a polymerized product. The starting monomers can be synthesized, using the above polymers in combination. In any case, the polymers can be prepared as insoluble particles against the dispersion (carrier liquid).

Coloring agents for use in the liquid developer include, for example, inorganic pigments, organic pigments, and dyes.

The inorganic pigments can be any conventional or known pigments. Among them, preferred inorganic pigments are as follows.

Examples of black inorganic pigments include carbon black pigments such as furnace black, channel black, acetylene black, thermal black, lamp black, or the like, as well as magnetic powders such as magnetite, ferrite, or the like.

Each of these black inorganic pigments can be used either alone or in combination of two or more, according to necessity.

Examples of white inorganic pigments include titanium oxide, silicon oxide, and the like. Each of these white inorganic pigments can also be used either alone or in combination of two or more.

A content of the inorganic pigment in the toner fine particles of the liquid developer is preferably from 2 parts by mass to 20 parts by mass, relative to 100 parts by mass of the resin component (polymer).

The organic pigments can be any conventional or known organic pigments and examples thereof are as follows.

Examples of magenta or red organic pigments include C-I-Pigment Red 2, C-I-Pigment R3, C-I-Pigment Red 5, C-I-Pigment Red 6, C-I-Pigment Red 7, C-I-Pigment Red 15, C-I-Pigment Red 16, C-I-Pigment Red 48:1, C-I-Pigment Red 53:1, C-I-Pigment Red 57:1, C-I-Pigment Red 122, C-I-Pigment Red 123, C-I-Pigment Red 139, C-I-Pigment Red 144, C-I-Pigment Red 149, C-I-Pigment Red 166, C-I-Pigment Red 177, C-I-Pigment Red 178, C-I-Pigment Red 222, and the like.

Examples of orange or yellow organic pigments include C-I-Pigment Orange 31, and C-I-Pigment Orange 43, and C-I-Pigment Yellow 12, C-I-Pigment Yellow 13, C-I-Pigment Yellow 14, C-I-Pigment Yellow 15, C-I-Pigment Yellow 17, C-I-Pigment Yellow 93, C-I-Pigment Yellow 94, and C-I-Pigment Yellow 138.

Green or cyan organic pigments include, but are not limited to, C-I-Pigment Blue 15, 15:2, 15:3, 16, and 60, C-I-Pigment Green 7, and the like.

Each of these organic pigments can be used either alone or in combination of two or more according to necessity. A content of the organic pigment in the toner fine particles in the liquid developer is preferably from 2 parts by mass to 20 parts by mass, and more preferably from 3 parts by mass to 15 parts by mass, relative to 100 parts by mass of the resin component (polymer).

Substances that enable chemical bonds by grafting, for example carbon black or metal oxide, can also be used as the organic pigments.

Any conventional or known dye can be used as the dye in the liquid developer of the present invention. Preferred dyes are oil-soluble dyes that is soluble in methyl methacrylate (MMA) as those used as a standard particle in the Examples mentioned below. Such oil-soluble dyes are dissolved in an amount of generally 1.0 part by weight or more, preferably 2.0 parts by weight or more, and more preferably 4.0 parts by weight or more, in 100 parts by weight of MMA at 25° C.

Preferred examples of oil-soluble dyes for use in the present invention include oil-soluble dyes of C.I. Solvent Blue 35, C.I. Solvent Red 132, C.I. Solvent Black 27, C.I. Solvent Yellow 16, and C.I. Solvent Blue 70, as well as OIL GREEN 502, OIL GREEN BG, and VALIFAST RED 3306 (trade names, available from Orient Chemical Industries, Ltd.). Among them, dyes capable of dissolving in an amount of 4.0 parts by weight or more, in 100 parts by weight of MMA are preferred.

By using such an oil-soluble dye having high solubility in MMA, the dye can be incorporated in a sufficient amount and can be prevented from discoloring during a polymerization process and other production processes of colored polymer particles so as to manufacture colored polymer particles having a uniform color tone.

Each of these oil-soluble dyes can be used either alone or in combination of two or more.

The amount of the oil-soluble dye can be set according to a desired color tone (hue) and is generally from 1.0 part by weight to 20 parts by weight, and preferably from 2.0 parts by weight to 10 parts by weight, relative to 100 parts by weight of an acrylic monomer.

The liquid developer of the present invention preferably comprises a dispersing agent to disperse solids in the carrier liquid so as to ensure insulating properties of the toner fine particles even in a high weight concentration. The resulting liquid developer can keep appropriate electric distances among the toner fine particles to avoid formation of a conductive path even when a low-resistance material comes close to the toner fine particles due to changes in the liquid developer. The liquid developer can thereby prevent charge injection from electrodes and can keep its high specific resistance and excellent durability.

Dispersing agents for use herein should preferably comprise materials that are compatible or miscible with the carrier liquid and can be adsorbed by the toner resin.

In Example (L) in the present invention, the liquid developer comprises dispersion medium, particles insoluble in dispersion medium, and particles soluble in dispersion medium.

Conventional hydrocarbon solvents, such as alkylnaphthenic hydrocarbons like liquid paraffin, isoparaffinic hydrocarbon, and paraffinic hydrocarbon, having a viscosity of 10 mPa·s or more at room temperature may be used for the hydrocarbon solvent in this Example (L). Adding dyes which are soluble in a hydrocarbon solvent and have different colors from the particles, into the dispersion medium is preferable in the case where it is used for dispersion of an image display medium such as an electrophoretic display.

Solid particle pigments such as metallic oxides are given as the simplest example of particles insoluble in hydrocarbon solvent. Resins insoluble in hydrocarbon solvent or one in which coloring agents are dispersed or mixed with the resin as a binder may be also used. All of the resins insoluble in hydrocarbon solvent of conventional thermoplastic resins and thermosetting resins can be used as a binder resin, preferably non-adherent materials. Examples of the binder resins include styrenes such as polyester resin, polystyrene, poly p-chlorostyrene, polyvinyl toluene, or the like, as well as monopolymers of substituents thereof. Copolymers, comprising monomers to be described later with good affinity for hydrocarbon solvents and multifunctional monomers as a crosslinking agent, can also be used. All conventional one may be used as the colored component. Examples of black coloring agents include carbon black, aniline black, furnace black, lamp black, and the like. Examples of the cyanogen coloring agents include phthalocyanine blue, methylene blue, victoria blue, methyl violet, aniline blue, ultra-marine blue, and the like. Examples of the magenta coloring agent include rhodamine 6G lake, dimethylquinacridone, watching red, rose bengal, rhodamine B, alizarin lake, and the like. Examples of the yellow coloring agent include chrome yellow, benzidine yellow, hansa yellow, naphthol yellow, molybdenum orange, quinoline yellow, tartrazine and the like. These coloring agents can be used in combination. A content of the coloring agent is preferably from 0.1 part by weight to 300 parts by weight, more preferably 1 part by weight to 100 parts by weight, relative to 100 parts by weight of the binder resin.

All of the resins soluble in hydrocarbon solvent selected from the conventional thermoplastic resins and thermosetting resins can be used as the binder resin; preferable is one with a strong attractive interaction with the particle surface rather than the hydrocarbon solvent. Adsorption of resins on the particle increases the stability of dispersion because of the steric effects. Examples of resins include copolymers consisting of at least one monomer with good affinity for hydrocarbon solvents such as alkilnaphthenic hydrocarbon, isoparaffinic hydrocarbon, or paraffinic hydrocarbon such as 2-ethylhexyl(meth)acrylate, octyl(meth)acrylate, nonyl (meth)acrylate, decyl(meth)acrylate, lauryl(meth)acrylate, stearyl(meth)acrylate, vinyllaurate, methyl(meth)acrylate, ethyl(meth)acrylate, buthyl(meth)acrylate, hexyl(meth) acrylate, cyclohexyl(meth)acrylate, benzil(meth)acrylate, phenyl(meth)acrylate, styrene, vinyltoluene, and the like.

Production of dispersion in the present invention employs mixing each of the aforementioned components in a hydrocarbon solvent. In this case, ball mills, sand mills, and attritor may be used for dispersion. However, it is to be understood that the order of mixing is not intended to be limited.

In Example (M) in the present invention, resins are used which either have acid groups but no bases as the above-mentioned resins soluble in hydrocarbon solvent in the dispersion, or have bases but no acid groups. Because the resins adsorb on the particles in the hydrocarbon solvent, the surface of these particles charges uniformly with positive or negative polarity due to the interaction between the acid or bases of the resins soluble in the solvent.

Examples of particle components insoluble in hydrocarbon solvent include all sorts of insoluble resins, conventional inorganic or organic pigments, metals, metallic oxides, magnetic particles, materials in wax state (for instance, low molecular weight polyolefin and wax), chemical products (for instance, pesticides), and inflating agents.

Moreover, all conventional coloring agents, such as carbon black, lamp black, ultramarine blue, aniline blue, copper phthalocyanine blue, copper phthalocyanine green, hansa yellow G, rhodamine 6G, lake color, chalcoil blue, chrome yellow, quinacridone, benzidine yellow, rose bengal, and triarylmethane dyes, can also be used. These may be used either alone or in combination of two or more. Specific examples include iron oxide such as magnetite, hematite, and ferrite, metals such as iron, carbonyl iron powder, cobalt, and nickel, and metallic alloys and mixtures of the above-mentioned metals and other metals such as aluminum, cobalt, copper, lead, magnesium, tin, zinc, antimony, beryllium, bismuth, cadmium, calcium, manganese, selenium, titanium, tungsten, vanadium, or the like. Glass beads may also be used. The following styrene block copolymers are used as the resin particles; monopolymers of styrene and substituents such as polystyrene, poly p-chlorostyrene, polyvinyl toluene, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methylmethacrylate copolymer,styrene-ethyl methacrylate, styrene-bythylmethacrylate copolymer, styrene-α-chloromethacrylate copolymer, styrene-acrylonitrile copolymer, styrene-vinylmethylether copolymer, styrene-vinyl ethylether copolymer, styrene-vinylmethylketone copolymer, styrene-butadiene copolymer, styrene-isoprene copolymer, styrene-acrylonitrile-indene copolymer, styrene-maleic acid copolymer, styrene-maleate copolymer, or the like.

Moreover, depending on use, the liquid developer and the dispersion may be colored by adding a silicone oil soluble dyestuff to the liquid developer or by making a chemical bond to a dispersion of the present invention. The aforementioned resin compounds and solid particles are mixed with silicone oil solvent to manufacture the liquid developer in the present invention. In this case, ball mills, sand mills, and attritor may be used for dispersion. However, it is to be understood that the order of mixing is not intended to be limited.

Materials that dissolve in the dispersion medium (carrier liquid) and adsorb on the toner resin are used as the dispersant.

In the case of hydrocarbon family dispersion media (carrier liquid) long-chain polymers are used to achieve effects of repulsive force. Examples of resins which are soluble in the above-mentioned hydrocarbon solvents for use in the present invention include the following materials.

(a) Resins having acid group but no base and being soluble in hydrocarbon solvents (polymers and copolymers comprising monomers having acid groups), which include copolymers consisting of at least one monomer with good affinity for hydrocarbon solvents described in Example (L) and at least one monomer with acid groups selected from (meth) acrylic acid, maleic acid, maleic anhydride, itaconic acid, itaconic acid anhydride, fumaric acid, cinnamic acid, crotonic acid, vinylbenzoic acid, 2-methacryloxyetyl succinic acid, 2-methacryloxyethyl maleate, 2-methacryloxyetylhexahydrophthalate, 2-methacryloxyetyltrimellitic acid, vinyl sulfonic acid, allylsulfonic acid, styrenesulfonic acid, 2-sulfoethylmethacrylate, 2-acrylamide-2-methylpropanesulfonic acid, 3-chloroamidephosphoxypropylmethacrylate, 2-methacryloxyethyl acidphosphate, hydroxystyrene, and the like.

(b) resins having bases but no acid group and being soluble in hydrocarbon solvents (polymers and copolymers comprising monomers having bases), which include copolymers consisting of at least one monomer with good affinity for hydrocarbon solvents described above and at least one monomer with bases selected from N-methylaminoethyl (meth)acrylate, N-ethylaminoethyl(meth)acrylate, N,N-dimethylaminoethyl(meth)acrylate, N,N-diethylaminoethyl (meth)acrylate, N,N-dibutylaminoethylacrylate, N-phenylaminoethylmethacrylate, N,N-diphenylaminoethylmethacrylate, aminostyrene, dimethylaminostyrene, N-methylaminoethylstyrene, dimethylamino ethoxy styrene, diphenylaminoethylstyrene, N-phenylaminoethylstyrene, 2-N-piperidylethyl (meth) acrylate, 2-vinylpyridine, 4-vinylpyridine, 2-vinyl-6-methylpyridine, and the like.

In the other Example (N) of the present invention, the dispersion includes resins being soluble in a hydrocarbon solvent, wherein resins (c) have acid groups but no bases, and contain nonionic polar groups, or (d) have bases but no acid groups, and contain nonionic polar groups. Because the resins adsorb on the particles in the hydrocarbon solvent, the surface of these particles charges uniformly with positive or negative polarity due to the interaction between the polar groups and the acid groups or bases of the solvent soluble resins.

The following examples are presented as the above-mentioned resins in the present invention.

(c) resins having bases but no acid group and including nonionic polar groups (copolymers comprising monomers with bases and monomers with nonionic polar groups), which include copolymers consisting of at least one monomer with acid groups selected from the previously described Example (M) and polar monomers such as 2-hydroxyethyl (meth)acrylate, 2,3-dihydroxypropyl(meth)acrylate, 4-hydroxybutyl(meth)acrylate, 2-hydroxy-3-propylmethacrylate, 2-chloroethyl(meth)acrylate, 2,3-dibromopropyl(meth)acrylate, (meth)acrylonitrile, isobutyl-2-cyanoacrylate, 2-cyanoethylacrylate, ethyl-2-cyanoacrylate, methacrylacetone, tetrahydrofurofurfurylmethacrylate, trifluoroethylmethacrylate, p-nitrostyrene, vinylpyrrolidone, acrylamide, methacrylamide, N,N-dimethylmethacrylaminde, N,N-dibutylmethacrylamide, and the like. Additionally, copolymers, including one or more monomers with good affinity for the aforementioned hydrocarbon solvent in the Example (M) cited above, may also be used.

(d) resins having bases but no acid group and including nonionic polar groups (copolymers comprising monomers with bases and monomers with nonionic polar groups), which include copolymers consisting of at least one monomer with bases selected from the previously described Example (M) and polar monomers mentioned above. Additionally, copolymers, including one or more monomers with good affinity for the aforementioned hydrocarbon solvent in the Example (M) cited above, may also be used.

In the other Example (O) of the present invention, the particles have acid groups but no bases, or have bases but no acid groups on the surface. Such particles charge the toner fine particles uniformly with positive or negative polarity due to the acid groups or bases in the hydrocarbon solvent.

As particles for use in the present invention, one can employ resins insoluble in hydrocarbon solvent which include monomers with either acid group or bases from the previously mentioned Example (M) and binders of coloring agents as mentioned above in Example (L). Moreover, when materials such as metallic oxides and carbon black that can be chemically bonded to the monomers by grafting are used as solid particles, monomers with the aforementioned acid group or bases may be combined with these materials, resulting in the formation of chemical bonds to those groups.

In the other Example (P) of the present invention, the particles have nonionic polar groups and (e) acid groups and no bases on the surface, or (f) have bases but no acid groups. Such particles uniformly charge positively or negatively due to the interaction between the acid group or bases and the nonionic polar groups in the hydrocarbon solvent.

As particles for use in the present invention, one can employ resins insoluble in hydrocarbon solvent, which include monomers with acid groups in the previously mentioned Example (M), resins insoluble in hydrocarbon solvent with polar groups in the previous Example (N), previously mentioned polar monomers, monomers having bases mentioned in the Example (M), and binders of coloring agents mentioned in the Example (L). Moreover, when materials such as metallic oxides and carbon black that can be chemically bonded to the monomers by grafting are used as solid particles, acid group or bases may be combined with polar groups by reacting those materials with monomers including the aforementioned acid or bases and polar monomers.

In the other Example (Q), (g) particles which have acid groups but no bases on the surface, or resins soluble in hydrocarbon solvent having bases but no acid group, or (h) particles which have bases and no acid groups on the surface, or resins soluble in hydrocarbon solvent which have acid groups but no bases.

At this time, acid-base separation occurs between acid group or bases on the particle surface and basic or acid groups of the resins soluble in hydrocarbon solvent. Ion-formation occurs at the interface between the particle surface and the solvent through solvation in the case where there are nonionic polar groups in the particle surface and/or resins soluble in hydrocarbon solvent. Consequently, the particles charge uniformly with positive or negative polarity, and the solid particles are dispersed more stably than heretofore due to the interaction of the electrostatic and the steric effects. The particles in the above-described Examples (O) and (P) may be used for the particles in this example. Additionally, resins soluble in hydrocarbon solvent mentioned in the Examples (M) and (N) may be applied as the resins soluble in hydrocarbon solvent in this example.

In the case of a silicone dispersion medium (carrier liquid), for instance, silicone rubber, both-end degenerated silicone oils with reactive organic groups, and one-end degenerated silicone oils may be used. In this usage, epoxy, methacrylic, or the like may also be selected as reactive organic groups for the dispersion medium, according to the toner resin.

Such dispersing agents include, for example, silicone rubbers, silicone oils modified at both ends and having a reactive organic group, and silicone oils modified at one end. The reactive group can be selected from, for example, epoxy group and methacrylic group, according to the type of the toner resin.

The dispersing agent and the dispersing group should be selected in consideration of affinity between the toner fine particles and the carrier liquid serving as the dispersion medium. If not, a toner layer after image formation on a sheet of paper may become heterogeneous. Specifically, a silicone dispersion medium may invite the following problems unless the affinity between the resin surface of the toner fine particles and the dispersion medium is appropriately set, in contrast to hydrocarbon dispersion media.

Figure 10:
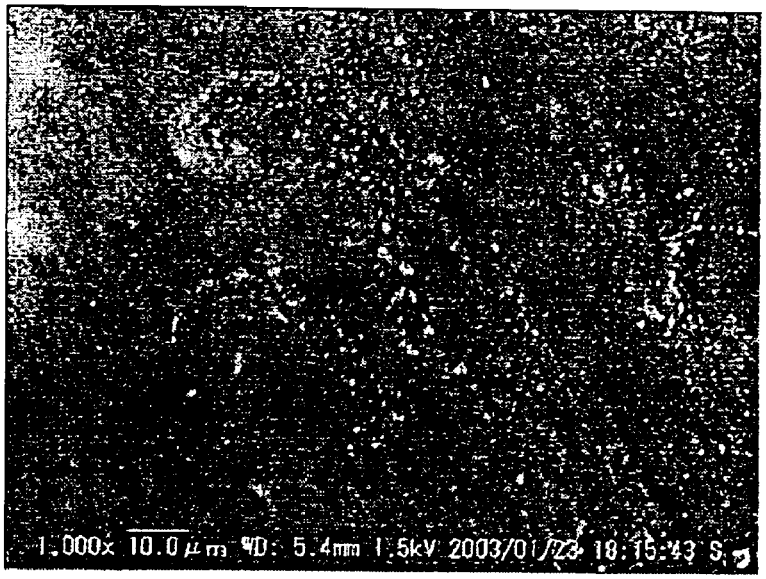
FIGS. 10 and 11 are each photographs of enlarged views of a toner layer after an image forming process using a silicone-containing or silicone-free dispersing agent to disperse toner fine particles into a silicone dispersion medium.
Figure 11:
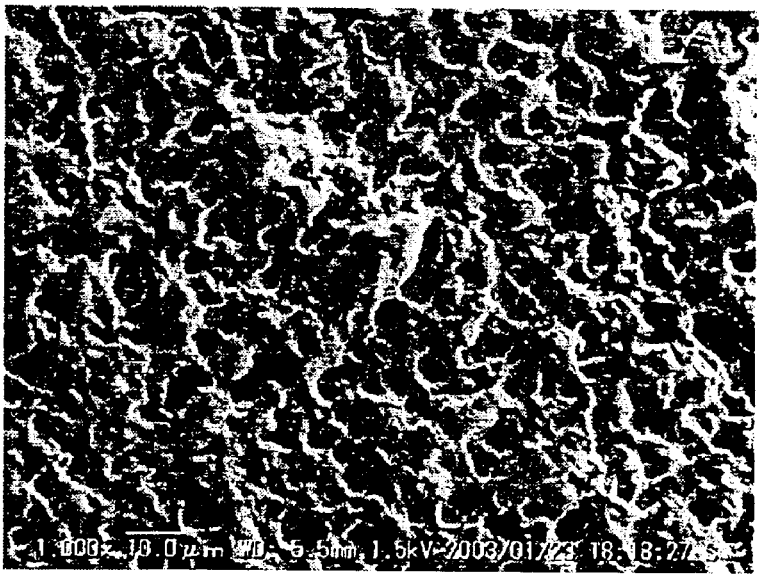

FIGS. 10 and 11 are enlarged images of a toner layer after an image forming process using a silicone-group containing dispersing agent and a dispersing group not containing a silicone group, respectively, in dispersion of the toner fine particles in a silicone dispersion medium. FIG. 10 shows that, by using a silicone-group-containing dispersing agent, the dispersibility of the toner layer on a paper after the image forming process is markedly improved.

When a hydrocarbon dispersion medium is used, its affinity for the surface of the toner resin is ensured by adding a dispersing agent comprising a polymer material having a long-chain hydrocarbon group such as an alkyl group or by imparting such a long-chain hydrocarbon group to the surface of the particles. In contrast, when a silicone dispersion medium is used, its affinity for the surface of the toner resin may not be ensured by these procedures. The dispersing agent for use in this case should have a silicone group.

The weight concentration of the toner fine particles in the liquid developer before being subjected to an image forming process is preferably 5% by weight or more and 40% by weight or less. The average particle diameter of the toner fine particles can be selected within a range from about 0.1 μm to about 6 μm according to the intended purpose. In general, the toner fine particles constitute aggregates each comprising about five to about ten particles on a printed transfer paper, and the resolution thereof becomes improved in substantially inverse proportion to the volume average particle diameter per one toner fine particle. If the volume average particle diameter of the toner fine particles is less than 0.1 μm, physical deposition power excessively increases to thereby deteriorate a transfer ratio. If it is more than 6 μm, the resolution may deteriorate.

The liquid developer may comprise a nonvolatile dispersion medium having a high boiling point, such as a silicone carrier liquid, as a part or whole of the carrier liquid. This configuration yields the aforementioned various advantages but may adversely affect image fixing on a recording medium.

When the carrier liquid is in excess in image-fixing onto a recording medium, it serves as a release agent between the recording medium and the toner fine particle, or between the toner fine particles themselves to thereby cause image-fixing offset. Accordingly, the amount of such a nonvolatile dispersion medium should preferably be minimized as small as possible to form images with high quality on the recording medium at a high speed.

The dispersing resin used as the dispersing agent or dispersing group in dispersion of the toner fine particles has good affinity for the dispersion medium and thereby may cause image-fixing offset when it is fixed with the toner fine particles.

The carrier liquid and the dispersing resin should preferably be removed in image-fixing onto the recording medium. However, if the carrier liquid is sufficiently removed before transfer or if the dispersing resin is not used, the toner fine particles may not maintain their insulating properties to thereby cause insufficient transfer and other problems in an image-fixing process.

More preferred dispersing groups from the viewpoint of the image-fixing process are those having affinity both for the dispersion medium and for the toner fine particles and being capable of releasing or dissociating from the toner fine particles at elevated temperatures. For example, when the toner fine particles have a silicone group as the dispersing group in a large amount on their surface, the toner fine particles have high dispersibility, but such a silicone group in excess may exhibit steric repulsive force and serve as steric hindrance in a thermal image-fixing process of the particles. This type of the toner fine particles can be used in an image forming process in which the silicone group is removed after transfer before image-fixing.

Figure 12:
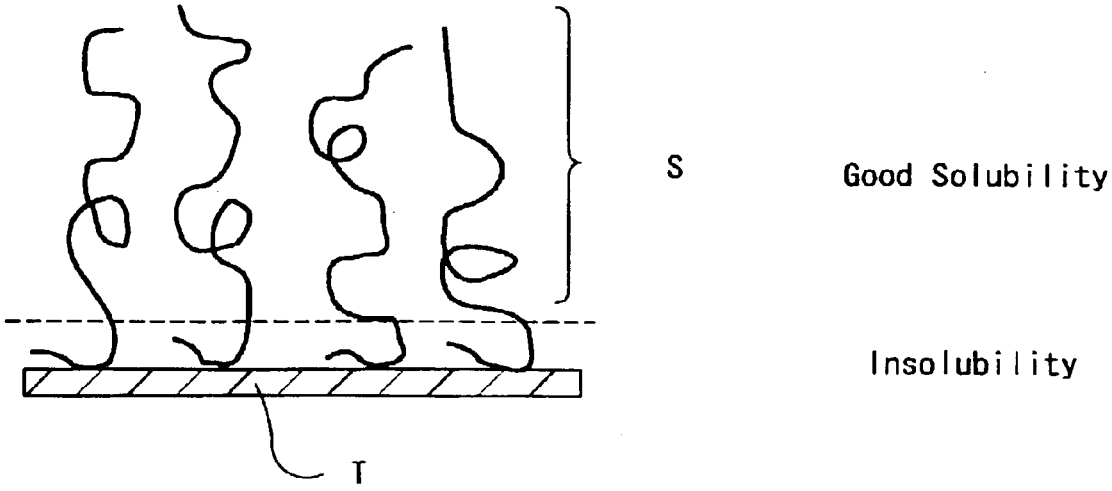
FIG. 12 is a schematic diagram showing an example of a surface of a silicone fine particle suitable for image-fixing.

Such a silicone-based developer will be illustrated with reference to FIG. 12. Initially, acrylic resin particles on the toner surface "T" are prepared by flushing the surface of carbon black with a non-crosslinked acrylic resin using a dimethylsilicone oil SH 200-50 cs (available from Dow Corning Toray Silicone Co., Ltd.) as the dispersion medium. The resulting acrylic resin particles have a glass transition temperature Tg of, for example, 80° C.

The surface of the toner fine particles is subjected to block polymerization with acrylic resin particles having a lower glass transition temperature (Tg) than that of the acrylic resin particles having Tg of 80° C. The lower glass transition temperature (Tg) is preferably 60° C. or lower, and more preferably 40° C. or lower (for example, 20° C. or lower). The acrylic resin particles having the above-mentioned Tg are added as a surface layer onto the surface of the tone fine particles. Silicone groups "S" are then added as the dispersing group to the surface layer. The silicone group serving as the dispersing group should have a molecular weight similar to that of the dispersion medium. The silicone groups "S" are a very good solvent in a silicone fluid and extends long as a blush to thereby serve as the dispersing group.

In this configuration, the silicone group has a molecular weight near to that of the solvent and the moiety having a low Tg is structurally thermally very weak. As the temperature rises, the acrylic resin moiety having a low Tg begins to be dissolved. Constraining force between the surface of the particles and the acrylic resin moiety having a low Tg in the dispersion medium decreases, and the concentration of the dispersing group in the vicinity of the surface of the particles significantly decreases, and the dispersing group is dispersed overall the carrier liquid.

Thus, the dispersing group dissociates from the toner fine particles with a rise in temperature, and the amount of the silicone group on the surface of the toner fine particles decreases, thus avoiding problems in a thermal image fixing process.

The dispersing group just mentioned above separates or dissociates from the particles upon application of heat as a trigger. The dispersing group plays a similar role as the dispersing agent or the coating layer for maintenance of insulating properties of the toner fine particles before the image-fixing process and dissociates from the surface of the toner resin in the image fixing process to thereby improve image-fixing properties.

EXAMPLES

The present invention will be described in further detail with reference to several examples and comparative examples below, each of which is not intended to limit the scope of the present invention.

(Preparation of Standard Particles)

In a 1-liter four-neck flask equipped with a thermometer and a nitrogen gas inlet tube, 100 parts by weight of methyl methacrylate (MMA) as a monomer and 300 parts by weight of water were placed, were mixed and were raised in temperature to 80° C. with stirring under flow of nitrogen gas.

The resulting mixture was further treated with 0.5 parts by weight of potassium peroxodisulfate at a constant temperature of 80° C. for 6 hours and thereby yielded a dispersion (a) of polymer particles.

The polymer particles in the dispersion (a) were observed on an electron micrograph to find that they are spherical particles having a substantially constant particle diameter and have an average particle diameter of 0.41 μm.

In another 1-liter four-neck flask equipped with a thermometer and a nitrogen gas inlet tube, 91.7 parts by weight of MMA and 1.0 part by weight of benzoyl peroxide were placed and were dissolved so as to form a solution, and the solution was further treated with 200 parts by weight of water, 3.3 parts by weight of Newcol 707SN (trade name, available from Nippon Nyukazai Co., Ltd., Tokyo, Japan) and 0.1 part by weight of sodium nitrite with vigorous stirring for 10 minutes.

The resulting mixture was further treated with 35 parts by weight of the polymer particles in the dispersion (a), which was obtained in the first polymerization process, at 50° C. for 30 minutes with gentle stirring, was further treated at 75° C. for 2 hours and thereby yielded a dispersion (b) of polymer particles. The polymer particles in the dispersion (b) were observed on an electron micrograph to find to be spherical monodisperse particles having an average particle diameter of 0.93 μm.

In another 1-liter four-neck flask equipped with a thermometer and a nitrogen gas inlet tube, 95.0 parts by weight of MMA and 1.0 part by weight of benzoyl peroxide were mixed so as to form a solution. The solution was further treated with 200 parts by weight of water, 3.3 parts by weight of Newcol 707SN (trade name, available from Nippon Nyukazai Co., Ltd., Tokyo, Japan) and 0.1 part by weight of sodium nitrite with vigorous stirring for 10 minutes.

The resulting mixture was further treated with 15.6 parts by weight of the polymer particles in the dispersion (b) with gentle stirring at 50° C. for 30 minutes, was further treated at 75° C. for 2 hours and thereby yielded a dispersion (c) of polymer particles.

The seed particles, which were the polymer particles in the dispersion (c), were observed on an electron micrograph to find to be spherical monodisperse particles having an average particle diameter of 2.12 μm.

To form colored particles, 2.0 parts by weight of an oil-soluble dye C-I-Solvent Blue 35 (solubility in 100 parts by weight of MMA: 4.2 parts by weight) and 1.0 part by weight of V-601, an azo polymerization initiator (trade name, available from Wako Pure Chemical Industries, Ltd.; dimethyl 2,2'-azobis(2-methylpropionate)), were dissolved in 80.0 parts by weight of an acrylic monomer methyl methacrylate (MMA), and the resulting solution was treated with 200 parts by weight of water, 10.0 parts by weight of an emulsifier Newcol 707SN (trade name, available from Nippon Nyukazai Co., Ltd., Tokyo, Japan), and 0.05 parts by weight of a polymerization inhibitor sodium nitrite with vigorous stirring for 10 minutes.

The resulting mixture was treated with 62.3 parts by weight of the seed particles, which were the polymer particles in the dispersion (c), with gentle stirring at 50° C. for 30 minutes, was treated at 80° C. for 2 hours, and then at 90° C. for 2 hours, so as to form a dispersion of colored particles.

The colored particles in the dispersion were observed on an electron micrograph to find to be spherical monodisperse particles having an average particle diameter of 3.98 μm.

C-I-Solvent Blue 35 was used as the coloring agent of the standard particles, but other dyes or pigments can also be used.

Various non-aqueous dispersions of polymers are known in the field of toner manufacturing.

The standard particles can also be prepared by a crystallization method as shown below, other than the polymerization method of an acrylic resin. Thus, toners can be manufactured by various processes using a variety of resins.

Initially, a nigrosine dye was dispersed in 100 parts by weight of ethanol, the resulting dispersion was treated with 25 parts by weight of a pigment, Carbon Black #2700 (trade name, available from Mitsubishi Chemical Corporation, Tokyo, Japan), and the resulting mixture was irradiated with ultrasonic wave for 20 minutes so as to disperse the carbon black sufficiently.

Next, ethanol was distilled off from the dispersion at a constant temperature of 40° C. under reduced pressure in an evaporator so as to yield a cake. The cake was roughly pulverized in a mortar, was further pulverized so as to yield a nigrosine-treated carbon black having a particle size from 0.1 μm to 0.8 μm. Instead of nigrosine, other dyes can be used for controlling the color in this procedure.

In a vessel equipped with a stirrer, a thermometer, a reflux condenser, and a vacuum deaerator, 4 parts by weight of the nigrosine-treated Carbon Black #2700, 720 parts by weight of a dimethylsilicone SH 2001 cSt (trade name, available from Dow Corning Toray Silicone Co., Ltd.), 480 parts by weight of an aromatic hydrocarbon toluene, 300 parts by weight of ethanol serving as aliphatic alcohol, 20 parts by weight of Dumiran C-5791 (trade name, available from Mitsui Takeda Chemicals, Inc.) serving as a partially saponified product of an ethylene-vinyl acetate copolymer, and 20 parts by weight of zirconium naphthenate (available from Dainippon Ink & Chemicals, Inc.) serving as a metallic soap were stirred at 50° C., which is 2° C. higher than the temperature T1 (48° C.) that Dumiran C-5791 begins to be dissolved in the solvent mixture, for 120 minutes, were maintained at 80° C. for 30 minutes. Thereafter, the resulting mixture was cooled from 80° C. to 30° C. over 180 minutes so as to precipitate toner fine particles.

The above-prepared toner fine particles have a volume-basis 50% particle diameter (median diameter) of 2.951 μm.

Example 1

A liquid developer having a composition shown in TABLE 1 was prepared in the following manner.

In a reactor equipped with a thermometer and a nitrogen gas inlet tube, 180 parts by weight of dimethylsilicone, 1 part by weight of methacrylic acid, 19 parts by weight of silicone-modified with a methacryloxy group at one end, and 1 part by weight of azobisisobutyronitrile were stirred and mixed, were then treated with stirring at 85° C., were further treated with stirring under flow of nitrogen gas for 3 hours, and then at 90° C. for 2 hours so as to yield an acidic-group-containing dispersing material.

In a reactor equipped with a thermometer and a nitrogen gas inlet tube, 180 parts by weight of 1 cSt serving as dimethylsilicone, 15 parts by weight of the standard particles, 1 part by weight of dimethylaminomethyl methacrylate, and 1 part by weight of azobisvaleronitrile were stirred and mixed, were treated with stirring at 50° C.

under flow of nitrogen gas for 10 hours, solids in the resulting reaction mixture were separated from dimethylsilicone so as to yield fine particles.

To 79.5 parts by weight of a dimethylsilicone (50 cSt) as a dispersion medium, 15 parts by weight of the above-prepared fine particles, 5 parts by weight of the acidic-group-containing dispersing material as a dispersing agent, and 0.5 parts by weight of zirconium octanoate as a charge control agent were added, the resulting mixture was milled and thereby yielded a black toner A1.

To control charge of the toner fine particles, dimethylaminomethyl methacrylate was added to a surface of each of the toner fine particles, and the acidic-group-containing dispersing agent was used in the above preparation. The dispersing agent has a molecular weight of several tens of thousands and serves as a dispersing agent by surrounding the surface of the toner resin.

Comparative Example 1

A black toner A2 was prepared by the procedure of Example 1, except that the acidic-group-containing dispersing material as the dispersing agent was not used.

TABLE 1

| Sample | Carrier liquid (% by weight) | Weight concentration of solids of toner fine particles (% by weight) | Dispersing agent (% by weight) | Charge control agent (% by weight) | Toner average particle diameter (μm) |
|---|---|---|---|---|---|
| A1 Ex. 1 | 79.5 | 15 | 5 | 0.5 | 3 |
| A2 Comp. Ex. 1 | 84.5 | 15 | 0 | 0.5 | 3 |

The black toner A1 (Example 1) had a surface tension of 30 dyn/cm or less, a boiling point of 100° C. or higher, and a viscosity of 300 mPa·s.

The black toners A1 and A2 were each used for liquid developers. Hereinafter, a liquid developer having A1 may be referred to as a "liquid developer A1," a liquid developer having A2 may be referred to as a "liquid developer A2." The liquid developer having A1 and the liquid developer having A2 were each subjected to image formation using the image-forming apparatus shown in FIG. 1. The toner layers after image formation were observed on microscope, and the observation results are shown in FIGS. 10 and 11.

With reference to FIG. 11, the liquid developer having A2 exhibits markedly deteriorated dispersibility. In contrast, the liquid developer having A1 exhibits improved dispersibility as shown in FIG. 10.

Figure 2:
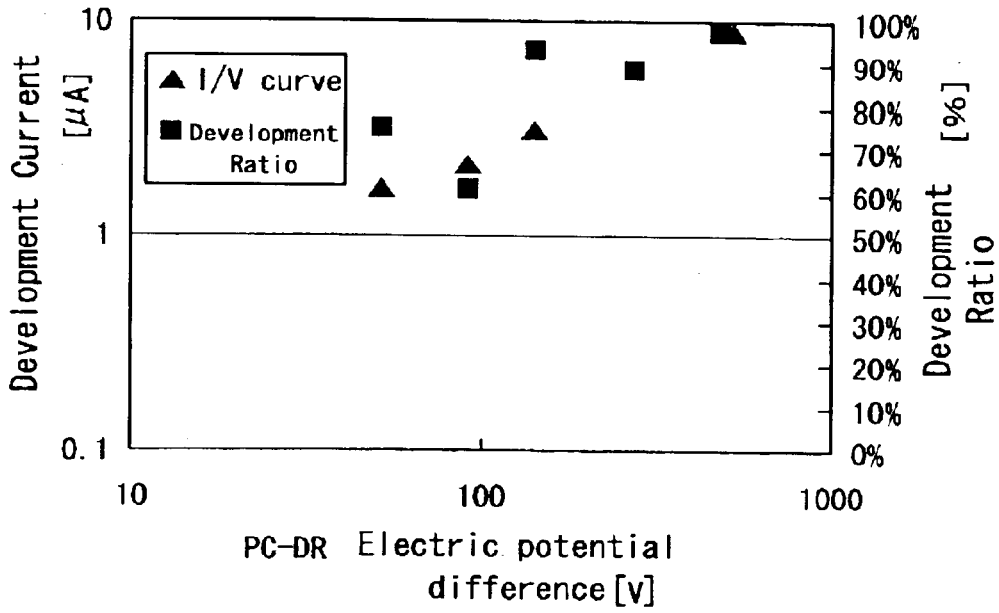
FIG. 2 is a graph showing a relationship between the electric potential difference and the development current between a photoconductor (PC) and a developing roller (DR)
Figure 3:
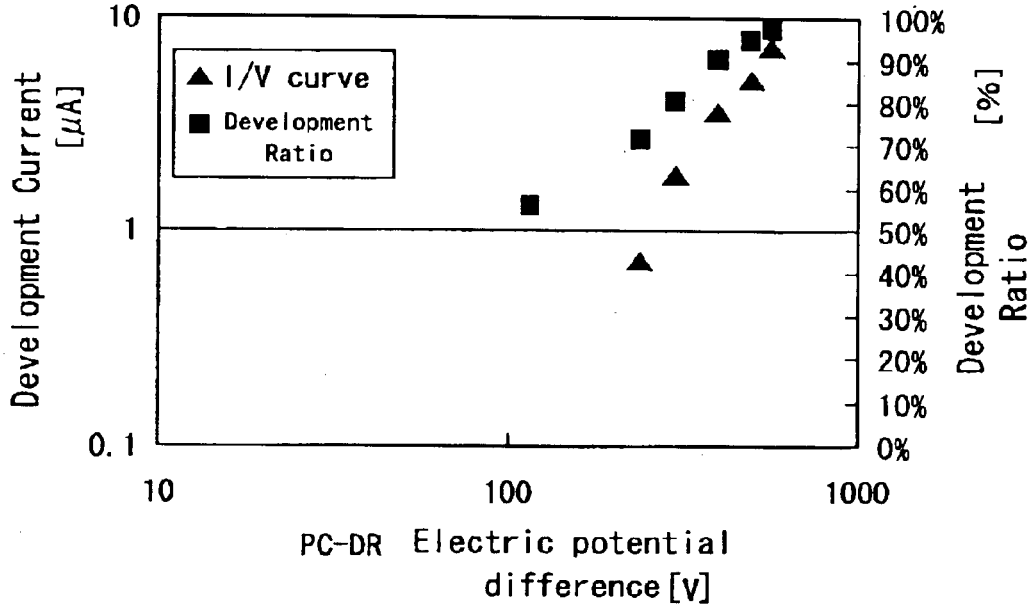
FIG. 3 is a graph showing another relationship between the electric potential difference and the development current between a photoconductor (PC) and a developing roller (DR)

Using the liquid developers each having A1 and A2, the relationship between the development current and potential difference between a photoconductor (PC) and a developing roller (DR) in an image developer were determined. The results are shown in FIG. 2. The relationship was determined at a nip width (width in a development nip part) of 3 mm, a process speed of 300 mm/sec. and a development time of 10 msec.

Under these conditions, the toner fine particles move and are compressed with decreased distances thereamong in the carrier liquid.

The liquid developer A2 allows to pass a larger current therethrough and shows a larger slope of the development current to the potential difference than the liquid developer A1 having the same weight concentration of solids of toner fine particles, particle diameter, and other parameters. The result show that the liquid developer A1 exhibits satisfactory insulating properties owing to the dispersing agent.

A sample liquid developer having a specific resistance of $1\times10^6$ Ωcm or less used herein could not keep its charges, and the toner fine particles could not sufficiently move in exact accordance with a latent electrostatic image, and liquid developer in question showed a development ratio of 50%.

Figure 4:
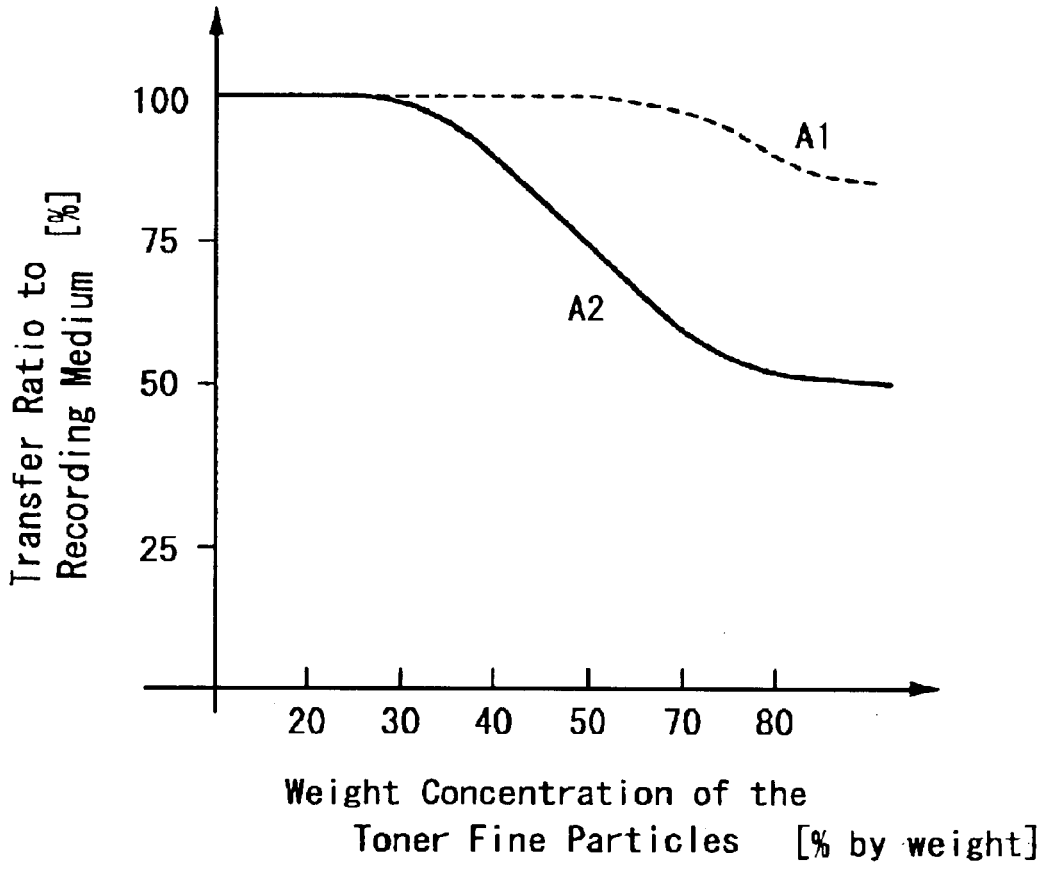
FIG. 4 is a graph showing a relationship between the toner density and the transfer rate of toner fine particles on a surface of a photoconductor drum serving as a latent electrostatic image support to an intermediate transfer.

FIG. 4 is a graph showing a relationship between the weight concentration of the toner fine particles in the liquid developer and the secondary transfer ratio to a transfer paper.

The secondary transfer ratio is calculated by dividing the difference in image density on an intermediate transfer between after primary transfer and after secondary transfer by the image density on the intermediate transfer after the primary transfer.

When the intermediate transfer is not used, the secondary transfer ratio is calculated by dividing the difference in image density on a photoconductor between before and after transfer by the image density on the photoconductor.

The weight concentration of the toner fine particles was determined based on an image density of a resin containing a coloring agent on each of the rollers in the image-forming apparatus.

The liquid developer A2 has a transfer ratio to a transfer paper of about 90% at a weight concentration of the toner fine particles in the liquid developer of 30% or less in order to produce a good image with less image deficiency. The liquid developer A2, however, has a decreased transfer ratio with an increase in the weight concentration of the toner fine particles in the liquid developer. In this graph, a transfer ratio of 50% or more is acceptable. The liquid developer A2 shows a transfer ratio of less than 50% at a weight concentration of the toner fine particles in the liquid developer of 70% or more, thus inviting imperfect secondary transfer. In contrast, the liquid developer A1 shows a satisfactorily high transfer ratio even at a weight concentration of the toner fine particles in the liquid developer of 70% or more. These results show that the liquid developer can keep its high transfer properties even at a high weight concentration of the toner fine particles by the use of the dispersing agent to physically keep the distances among the dispersed toner fine particles.

The mechanism of imperfect transfer due to an increased weight concentration of the toner fine particles in the liquid developer will be described below. A developer comprises a carrier liquid having a high flash point and an insulating resin serving as toner fine particles and containing a pigment component (hereinafter referred to as "toner resin") dispersed in the carrier liquid. Alternatively, a uniformly dispersed developer is prepared by dispersing a toner resin containing a carrier liquid and a coloring agent component in a mixture of appropriate amounts of a dispersing resin and a charge control agent. When the coloring agent component is a pigment having a low electrical resistance, such as carbon black, the conductive particles of carbon black surround the outer periphery of the toner fine particles.

Figure 13A:
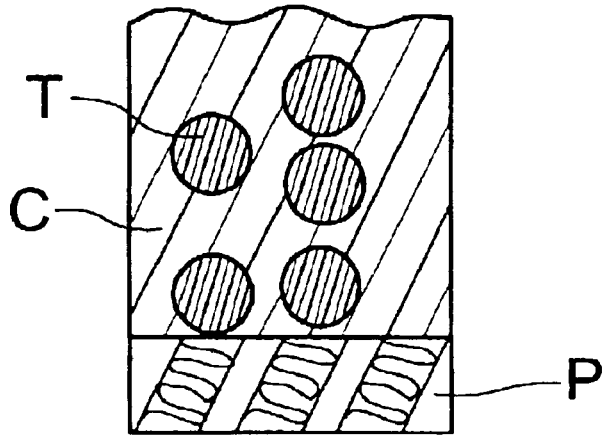
FIG. 13A is a diagram showing toner fine particles dispersed in a dispersion medium (carrier liquid)
Figure 13B:
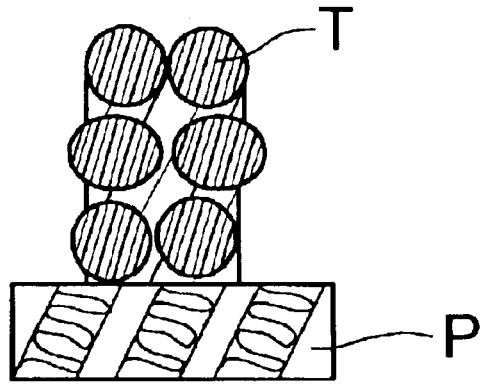
FIG. 13B is a diagram showing an example of a toner fine particle layer.

When the carrier is removed from this liquid developer for improving image-fixing properties, the toner fine particles with each other and the carbon black with each other are combined to thereby yield a toner fine particle "T" layer. This is because of the absence of the carrier liquid which was serving as an insulating film on the outer periphery of the toner fine particles. In FIG. 13A, the toner fine particles "T" are dispersed in the carrier "C." In FIG. 13B, the carrier C is removed and the toner fine particles form a layer. The resulting toner fine particle layer has a low electric resistance, and thereby the toner fine particles cannot keep their insulating properties. When a positively charged liquid developer receives a minus transfer bias in a primary transfer nip part or a secondary transfer nip part as in the present embodiment, charges are injected thereinto, and thereby the polarity of the toner fine particles cannot be maintained. Namely, the polarity of the toner is reversed, and the movement of the toner fine particles cannot be controlled by an electric field formed by the application of the transfer bias.

More preferably, a nonvolatile dispersion medium is used as the carrier liquid for avoiding a high weight concentration of the toner fine particles due to evaporation of the medium.

The liquid developer according to the present embodiment uses a carrier having a high flash point and a high electric resistance. Such a carrier having a high flash point does not substantially volatilize. Accordingly, the liquid developer of the present embodiment uses a carrier having a flash point of 250° C. or higher. Herein, the flash point is determined, for example, according to a Tag closed cup test system, a Seta closed cup test system, and a Cleveland open cup test system, each of which has a different temperature range to be determined. Specifically, the Tag closed cup test system determines a flash point lower than 0° C., the Seta closed cup test system determines a flash point in a range from 0° C. to 80° C. while determining a kinematic viscosity. The Cleveland open cup test system determines a flash point of 80° C. or higher. The flash points of the liquid developers of the present invention are determined according to the Cleveland open cup test system.

Examples of the carriers having a high flash point include silicone oil SH 200-50CS (trade name, available from Dow Corning Toray Silicone Co., Ltd.) having a flash point of 310° C., dimethylsilicone oil SH 200-20CS (trade name, available from Dow Corning Toray Silicone Co., Ltd.) having a flash point of 255° C., dimethylsilicone oil SH 200-20CS (trade name, available from Dow Corning Toray Silicone Co., Ltd.) having a flash point of 325° C., silicone oil KF-96-50CS (available from Shin-Etsu Chemical Co., Ltd.) having a flash point of 310° C., and the like. Each of these flash points was determined according to the Cleveland open cup test system. Carriers having a low flash point include, for example, Isopar L (trade name, available from Exxon Mobile Corporation) having a flash point of 60° C., Isopar G (trade name, available from Exxon Mobile Corporation) having a flash point of 41° C., and the like.

In the printer used in the present embodiment, the secondary transfer properties of a developer having a varying specific resistance were determined according to the following criteria, and the results are shown in TABLE 2.

○: The image was transferred satisfactorily

×: The image was not transferred satisfactorily

TABLE 2

| Specific resistance of toner layer [Ω cm] | Secondary transfer properties | Weight concentration of the toner fine particles in the liquid developer (% by weight) |
|---|---|---|
| $10^3$ to $10^6$ | X | 70 |
| $10^6$ to $10^{10}$ | ○ | 50 |
| $10^{10}$ to $10^{14}$ | ○ | 30 |

Each of the ranges of the specific resistance in TABLE 2 includes a lower limit and excludes an upper limit. The liquid developer A1 used in the present embodiment has a specific resistance in a range from $10^{10}$ to $10^{14}$ Ωcm at a weight concentration of the toner fine particles in the liquid developer of 30% by weight, a specific resistance in a range from $10^6$ Ωcm to $10^{10}$ Ωcm at a weight concentration of the toner fine particles in the liquid developer of 50% by weight, and a specific resistance in a range from $10^3$ to $10^6$ Ωcm at a weight concentration of the toner fine particles in the liquid developer of 70% by weight.

These results show that the liquid developer exhibits good secondary transfer properties at a specific resistance of the toner layer of $10^6$ Ωcm or more and exhibits insufficient secondary transfer properties at a specific resistance of the toner layer of less than $10^6$ Ωcm, and that the specific resistance of the liquid developer A1 decreases with an increasing weight concentration of the toner fine particles in the liquid developer.

In the liquid developer A1, the pigment component exposed on a surface of the toner fine particles is preferably coated with a dispersing resin. The pigment component carbon black is more preferably treated to have a high resistance.

The liquid developer according to the present invention can keep its high resistance even at a high weight concentration of the toner fine particles during image-forming, regardless of whether it is volatile or nonvolatile in an insulating liquid. This was electrically verified by determination according to an alternating current impedance method.

Figure 5:
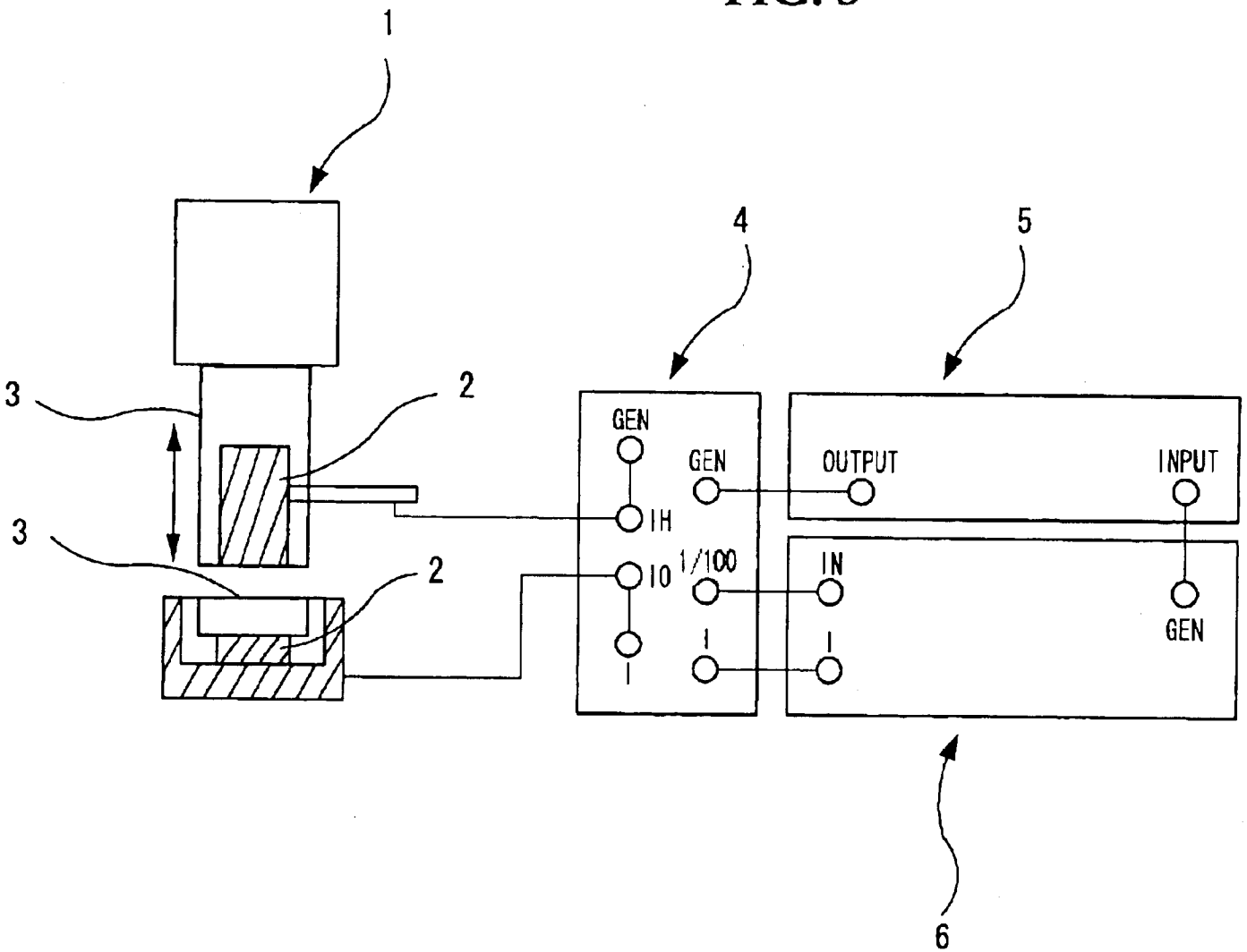
FIG. 5 is a schematic diagram showing an example of a system for determining electric conduction according to an alternating current impedance method.

The alternating current impedance method is used in the determination of electric conductivity in the field of electrochemistry. With reference to FIG. 5, from a micrometer 1, an alternating voltage is applied between parallel-plate electrodes 2, which are formed of Au, and the frequency response of impedance is determined. Devices used in the process shown in FIG. 5 are Solatron 1260 impedance analyzer 6 (trade name, available from Solatron Instruments Ltd.), a High Speed Power Amplifier Model 4105 5 (trade name, available from NF Corporation, Yokohama, Japan), and a high-resistance sample box Model 6104 SOL 4 (trade name, available from Toyo Corporation, Tokyo, Japan). The conditions in the determination are as follows.

Electrode area "S": $2.541\times10^{-4}$ $\Omega m^2$

Gap distance "d": $1.00\times10^{-4}$ m

Applied voltage: AC 5, 10, 50, 100, 200, 300, and 400 V (effective values)

Frequency: 1 Hz to 2000 Hz

Ambient condition: 25° C. in a thermostat

The amplifier was set to have a gain of 200, was attenuated to one hundredth in the high-resistance sample box and was placed again in the impedance analyzer.

Figure 6:
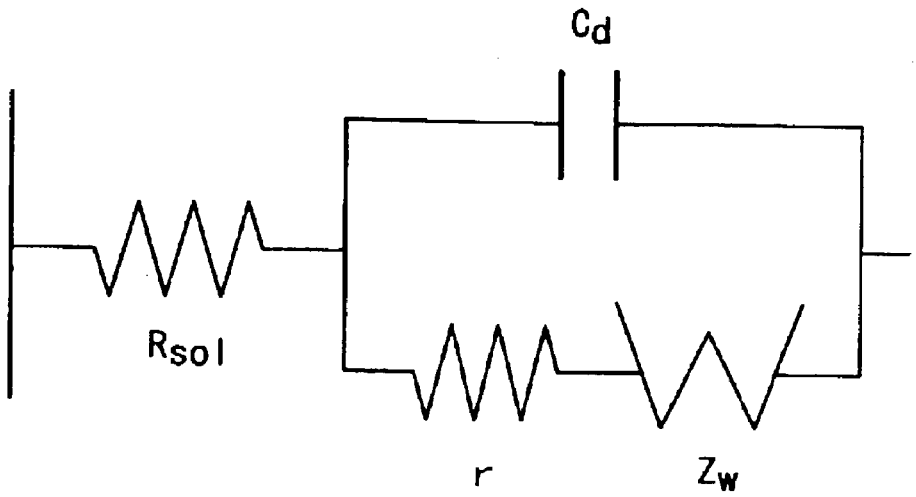
FIG. 6 is a schematic diagram showing an example of an electric circuit for the determination according to the alternative current impedance method.
Figure 7:
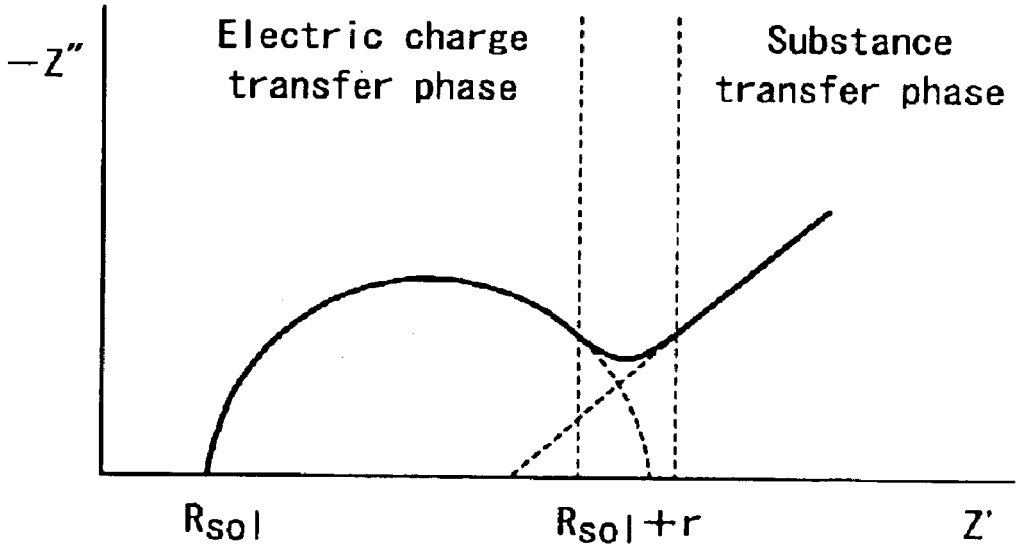
FIG. 7 is a graph showing a relationship among a resistance (including intraelectrode conduction) corresponding to electric conductivity in the liquid developer, an electrical double-layer capacitor, an electronic resistance corresponding to a velocity of an electron exchange during an electrode reaction, and the Warburg impedance.

An electric circuit shown in FIG. 6 was used to the determination, wherein "Rsol" is a resistance (including intraelectrode conduction) corresponding to electric conductivity in the liquid developer; "Cd" is an electrical double-layer capacitor; "r" is the electronic resistance corresponding to a velocity of an electron exchange during an electrode reaction; and "Zw" is the Warburg impedance. The relationship among "Rsol," "Cd," "r," and "Zw" is shown in FIG. 7.

Figure 8:
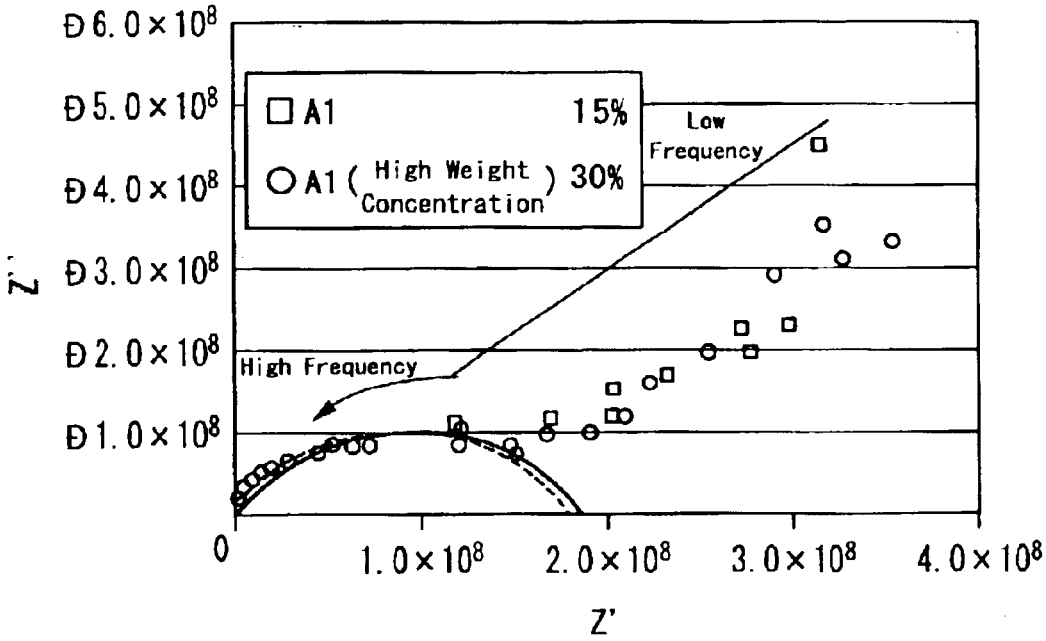
FIGS. 8 and 9 are graphs showing changes in electric properties due to changes in concentration of a liquid developer according to the present invention.
Figure 9:
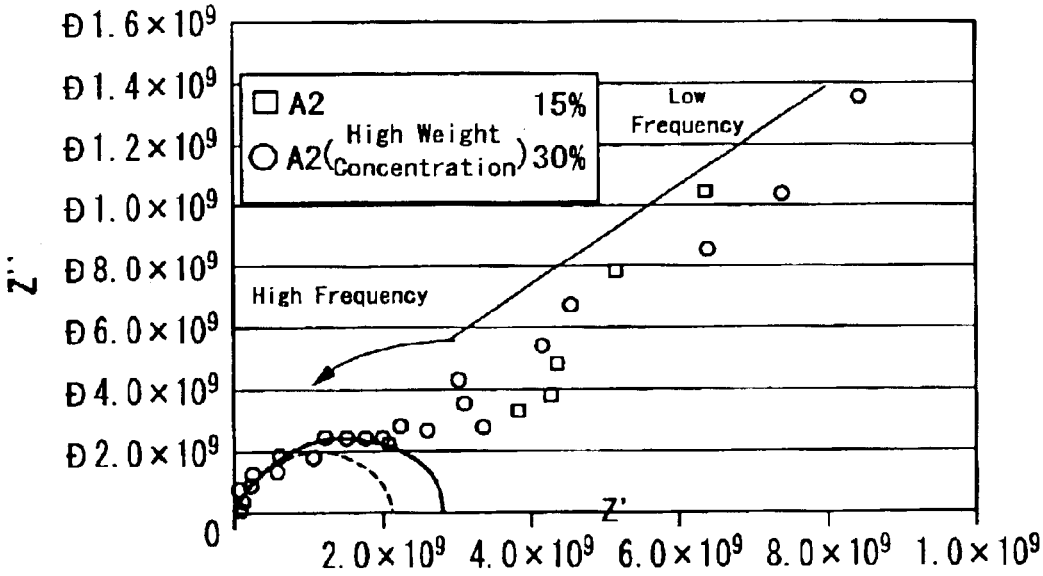

FIGS. 8 and 9 are graphs showing changes in electric properties with changes in a weight concentration of the toner fine particles in the liquid developers.

The liquid developer A1 does not show changes in electric capacity and electric resistance with a varying weight concentration of the toner fine particles. It can keep its electric properties even if a weight concentration of the solids of the toner fine particles changes.

The liquid developer A2 shows a decreased electric capacity obtained by an alternating current impedance and a decreased electric resistance at a weight concentration of solids of the toner fine particles of 30% by weight, which is twice more than the initial concentration. The specific resistance of the dispersion rapidly decreased, when the weight concentration of solids of the toner fine particles exceeded a certain degree. The decreased in specific resistance would invite problems in an electrostatographic process.

The electric properties of the liquid developers A1 and A2 are shown in TABLE 3, indicating that the liquid developer A2 has a decreased electric capacity as a weight concentration of the toner fine particles increases. In this connection, these properties were determined under the application of a voltage of 400 V.

TABLE 3

| Weight concentration of toner fine particles | Electrical double-layer capacitor Cd [F] 15% by weight | 30% by weight |
|---|---|---|
| A1 (Example 1) | 6.06E−11 | 6.08E−11 |
| A2 (Comp. Ex. 1) | 7.55E−11 | 3.68E−11 |

The decreased electric capacity of the liquid developer A2 indicates that charges are injected from the photoconductor drum serving as a latent electrostatic image support or an electrode of the developing roller, which affects the charge polarity of the toner fine particles, deteriorates the movement of the toner fine particles and decreases their durability.

The above properties were determined at weight concentrations of toner fine particles of 15% by weight and 30% by weight. The electric capacity was determined with a varying weight concentration of the toner fine particles within a range from 5% by weight to 70% by weight. The results are shown in TABLE 4.

TABLE 4

| Weight concentration of the toner fine particles | Electrical double-layer capacitor for A1 (Ex.) | Specific resistance of dispersion for A1 (Comp. Ex.) | Electrical double-layer capacitor for A2 (Ex.) | Specific resistance of dispersion for A2 (Comp. Ex.) |
|---|---|---|---|---|
| 5% by weight | 6.05E−11 | 3.38E+6 | 7.48E−11 | 3.41E+6 |
| 10% by weight | 6.10E−11 | 3.26E+6 | 7.54E−11 | 3.39E+6 |
| 30% by weight | 6.06E−11 | 3.28E+6 | 3.68E−11 | 3.22E+6 |
| 50% by weight | 6.08E−11 | 3.15E+6 | — | — |
| 70% by weight | 5.46E−11 | 2.44E+6 | — | — |

The capacitor component of the liquid developer A2 having high weight concentration of the toner fine particles could not be determined due to its high electric conductivity.

Example 2

In a reactor equipped with a thermometer and a nitrogen gas inlet tube, 180 parts by weight of dimethylsilicone (1 cSt), 15 parts by weight of the standard particles, 1 part by weight of dimethylaminomethyl methacrylate, 5 parts by weight of a silicone-modified with a methacryloxy group at one end, and 1 part by weight of azobisvaleronitrile were stirred, were further treated with stirring at 50° C. under flow of nitrogen gas for 10 hours, solids in the resulting reaction mixture were separated from the dimethylsilicone and thereby yielded fine particles.

To 79.5 parts by weight of a dimethylsilicone (50 cSt) as a dispersion medium, 20 parts by weight of the above-prepared fine particles, and 0.5 parts by weight of zirconium octanoate as a charge control agent were added, the resulting mixture was milled and thereby yielded a black toner B1.

Comparative Example 2

A black toner B2 was prepared by the procedure of Example 2, except that the silicone-modified with a methacryloxy group at one end was not used in the preparation of the fine particles.

The black toner B2 showed significantly insufficient dispersibility in silicone, as in the liquid developer A2 according to Comparative Example 1.

TABLE 5

| Weight concentration of the toner fine particles | Electrical double-layer capacitor for Ex. 2 | Specific resistance of dispersion for Ex. 2 | Electrical double-layer capacitor for Comp. Ex. 2 | Specific resistance of dispersion for Comp. Ex. 2 |
|---|---|---|---|---|
| 5% by weight | 6.10E−11 | 3.57E+6 | 9.24E−11 | 3.43E+6 |
| 10% by weight | 5.97E−11 | 3.43E+6 | 7.23E−11 | 3.44E+6 |
| 30% by weight | 5.87E−11 | 3.26E+6 | 6.36E−11 | 3.12E+6 |
| 50% by weight | 5.74E−11 | 3.25E+6 | — | — |
| 70% by weight | 5.23E−11 | 2.35E+6 | — | — |

The test results in Example 2 and Comparative Example 2 were similar to those in Example 1 and Comparative Example 1, respectively. These results show that similar results as in the addition of a dispersing agent can be obtained by adding a dispersing group to the surface of the toner fine particles. In addition, similar advantages were obtained by covering the pigment as a low-resistance substance with a polymer and dispersing the covered pigment in the toner resin to thereby avoid close contact among the pigment particles.

Example 3

In a reactor equipped with a thermometer and a nitrogen gas inlet tube, 180 parts by weight of a branched chain aliphatic hydrocarbon Isopar G (trade name, available from Exxon Mobile Corporation), 1 part by weight of methacrylic acid, 19 parts by weight of lauryl methacrylate, and 1 part by weight of azobisisobutyronitrile were placed and stirred, were further treated with stirring at 85° C. under flow of nitrogen gas for 3 hours, and then at 90° C. for 2 hours and thereby yielded an acidic-group-containing dispersing material.

In another reactor equipped with a thermometer and a nitrogen gas inlet tube, 180 parts by weight of Isopar G (trade name, available from Exxon Mobile Corporation), 15 parts by weight of the standard particles, 1 part by weight of dimethylaminomethyl methacrylate, and 1 part by weight of azobisvaleronitrile were placed and stirred, were further treated with stirring at 50° C. under flow of nitrogen gas for 10 hours, solids in the resulting reaction mixture were separated from the dimethylsilicone and thereby yielded fine particles.

To 79.5 parts by weight of a branched chain aliphatic hydrocarbon Isopar H (trade name, available from Exxon Mobile Corporation) (50 cSt) serving as a dispersion medium, 15 parts by weight of the above-prepared fine particles, 5 parts by weight of the acidic-group-containing dispersing material as a dispersing agent, and 0.5 parts by weight of zirconium octanoate as a charge control agent were added, the resulting mixture was milled and thereby yielded a black toner C1.

To control charges of the toner fine particles, dimethylaminomethyl methacrylate was added to their surface, and the acidic-group-containing dispersing agent was used in the above preparation. The dispersing agent has a molecular weight of several tens of thousands and serves as a dispersing agent by surrounding the surface of the toner resin.

Comparative Example 3

A black toner C2 was prepared by the procedure of Example 3, except that the acidic-group-containing dispersing material as the dispersing agent was not used.

The black toner C1 according to Example 3 has good dispersibility, can keep its electric insulating properties and exhibits good transfer properties even with the use of a non-polar solvent other than the silicone oil as the dispersion medium (carrier liquid), as in the black toner A1 according to Example 1. In contrast, the black toner C3 according to Comparative Example 3 cannot keep its electric insulating properties, has a decreased specific resistance and thereby exhibits deteriorated transfer properties, although it has better dispersibility than those according to Comparative Examples 1 and 2, since the black toner C3 uses a hydrocarbon dispersion medium as a solvent.

Silicone oils and Isopar grades were used as a non-polar solvent in these examples. However, the aforementioned non-polar solvents can also be used as long as they have electric insulating properties.

These liquid developers A1, B1, and C1 can keep their specific resistance to some extent even at a high weight concentration of the toner fine particles and can keep their good transfer properties even when the carrier in the developer is removed to some extent for improving image-fixing properties. They can thereby improve image-fixing properties easily. Accordingly, by using the liquid developers A1, B1, and C1 in image formation, satisfactory transfer properties and image-fixing properties can be obtained at the same time.

Dissociation of the dispersing group by action of heat is effective to further improve both the transfer properties and image-fixing properties. This embodiment will be illustrated below.

Example 4

In a reactor equipped with a thermometer and a nitrogen gas inlet tube, 180 parts by weight of a dimethylsilicone (1 cSt), 15 parts by weight of the standard particles, 3 parts by weight of 2-ethylhexyl methacrylate, 1.5 parts by weight of n-butyl methacrylate, and 1 part by weight of azobisisobutyronitrile were placed and stirred, were further treated with stirring at 50° C. under flow of nitrogen gas for 10 hours and thereby yielded fine particles.

The above-prepared fine particles were subjected to block polymerization with acryl having a low glass transition temperature (Tg), and were then added as surface layer onto surface of the fine particles.

Thereafter, in a reactor equipped with a thermometer and a nitrogen gas inlet tube, 180 parts by weight of dimethylsilicone (1 cSt), 15 parts by weight of the above-prepared fine particles having the acryl having a low glass transition temperature on surface thereof, 1 part by weight of dimethylaminomethyl methacrylate, 5 parts by weight of a silicone-modified with a methacryloxy group at one end, and 1 part by weight of azobisvaleronitrile were treated with stirring at 50° C., and further treated with stirring under flow of nitrogen gas for 10 hours and thereby yielded fine particles.

To 79.5 parts by weight of a dimethylsilicone (50 cSt) as a dispersion medium, 20 parts by weight of the above-prepared fine particles, and 0.5 parts by weight of zirconium octanoate as a charge control agent were added, the resulting mixture was milled and thereby yielded a black toner D.

In this procedure, dimethylaminomethyl methacrylate for controlling the charges of the toner fine particles and the silicone group for dispersion were added to the surface of the toner fine particles, respectively.

The coating layer in the present example was formed by polymerization, but it can also be formed by any other procedure such as spraying or dipping.

The silicone group serving as the dispersing group should have a molecular weight similar to that of the dispersion medium. The silicone group is a very good solvent in a silicone fluid and extends long as a blush to thereby serve as a dispersing group. The acrylic resin moiety having a low Tg is structurally thermally very weak. As the temperature rises, the acrylic resin moiety having a low Tg begins to be dissolved. Constraining force between the surface of the toner fine particles and the low-Tg acrylic resin moiety in the dispersion medium decreases, and the concentration of the dispersing group in the vicinity of the surface of the toner fine particles significantly decreases, and the dispersing group is dispersed overall the carrier.

Thus, the dispersing group dissociates from the toner fine particles with an elevating temperature, and the amount of the silicone group on the surface of the toner fine particles decreases, avoiding problems in a thermal image fixing procedure. If the dispersion medium is reduced in amount to an extreme extent, the toner fine particles may not maintain their insulating properties due to the absence of the dispersion medium serving as an insulating film on the outer periphery of the toner fine particles. The liquid developer must also avoid this problem.

The dispersing group used in this liquid developer dissociates from the toner fine particles upon application of heat as a trigger. The dispersing group plays a similar role as the dispersing agent or the coating layer for maintaining the insulating properties of the toner fine particles before an image-fixing process and then dissociates or separates from the surface of the toner resin in the image-fixing process. Thus, the resulting liquid developer can also have improved image-fixing properties.

This embodiment has been illustrated by taking an acrylic resin as an example of the moiety capable of dissociating from the toner resin. However, this component is not specifically limited to acrylic resins, as long as it can exhibit a similar function.

A more preferable dispersing agent is those showing affinity to both the solvent and the toner fine particles, maintaining electric insulativity, and dissociating the toner fine particles as the temperature rises.

A description will be given regarding electric properties of the liquid developer of the Example 4.

EXAMPLES 1, 2, and 3 and also COMPARATIVE EXAMPLES 1, 2, and 3, even when the weight concentration of the toner fine particles was high, the electric properties of the liquid developer, which maintains high resistance, were observed and confirmed by an alternating current impedance.

TABLE 6

| Weight Concentration of the Toner Fine Particles | Electrical Capacitance | Specific Resistance of Dispersion |
|---|---|---|
| 5% by weight | 7.51E−11 | 2.81E+6 |
| 10% by weight | 7.48E−11 | 2.82E+6 |
| 30% by weight | 7.41E−11 | 2.70E+6 |
| 50% by weight | 7.10E−11 | 2.74E+6 |
| 70% by weight | 6.82E−11 | 2.32E+6 |

The following EXAMPLE 5 is given as an example of an image-fixing apparatus of the present invention to fix the secondary transferred unfixed toner image on both sides of a transfer paper.

Example 5

Figure 14:
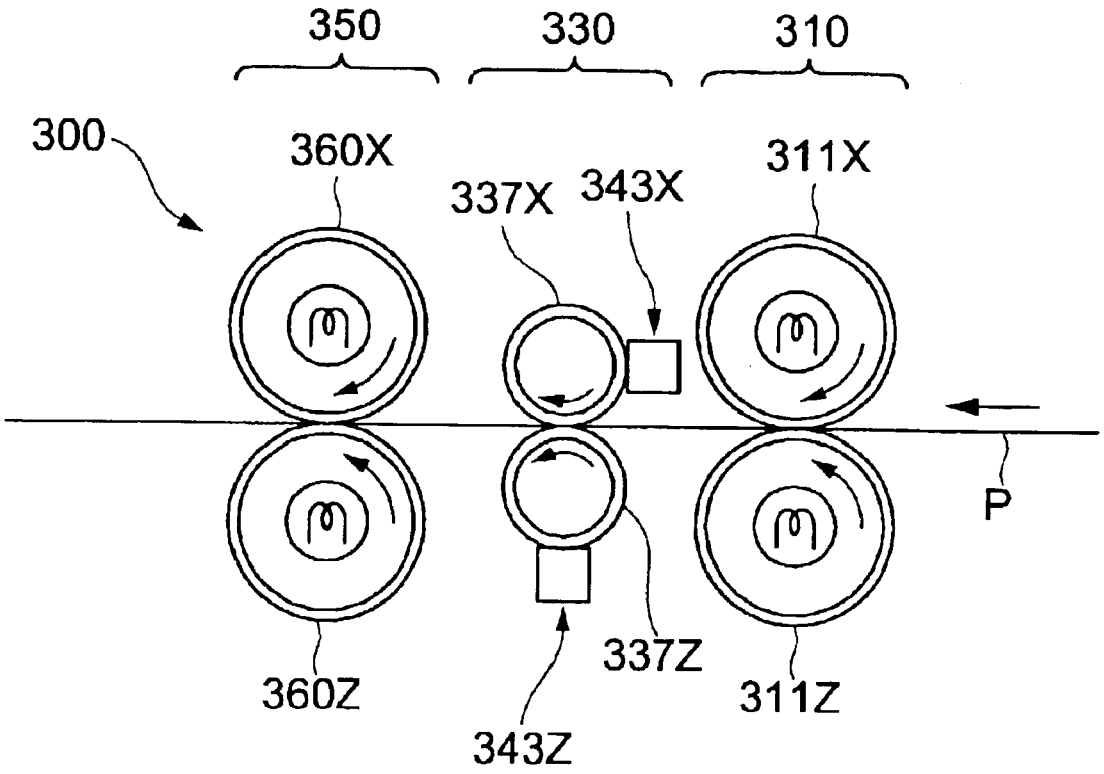
FIG. 14 is a schematic diagram showing an example of an image-fixing apparatus utilized in EXAMPLE 5 of the present invention.

FIG. 14 is a schematic view showing an example of the image-fixing apparatus of EXAMPLE 5.

The image-fixing apparatus 300 comprises pre-heater 310 including a pair of pre-heating rollers 311X and 311Z, a carrier-remover 330 including a pair of carrier-removing rollers 337X and 337Z, and heat fixer 350 including a pair of fixing rollers 360X and 360Z. A transfer paper P is transported between each of the rollers in a direction of the arrow.

Each of the pair of the carrier-removing rollers 337X and 337Z contains poroelastic materials on surfaces thereof, and the poroelastic materials have microcells and porous heat-resistance properties. Examples of the poroelastic materials include those having a hole diameter of 0.1 $\mu$m to 1.0 $\mu$m and thickness of 50 $\mu$m to 300 $\mu$m. Specific examples of the poroelastic materials include cellulose acetate, polycarbonate, urethane, hydrin, polyimide, and the like. Microcells of the these materials retain absorbed carrier liquid. Additionally, these materials are preferably a lipophilic material with absorptivity and swelling properties with respect to the carrier liquid. Cleaning units 343X and 343Z are provided as the solvent-collectors for the pair of carrier-removing rollers 337X and 337Z, respectively.

The operations in the EXAMPLE 5 will be described as follows.

The transfer paper P is transported to the pre-heater 310, enters the gap between pair of pre-heating rollers 311X and 311Z, and is then heated. Here, the pair of pre-heating rollers 311X and 311Z are heated up to about 120° C. to 150° C. by heaters installed into the rollers. The transfer paper P entering between the pre-heating rollers 311X and 311Z is heated from both sides, and the carrier liquid contained in the toner image oozes out, because the resin in the toner image becomes film. A portion of the carrier liquid penetrates into the transfer paper P, and the rest of the carrier liquid oozes out to an upper surface of the toner image.

Figure 15A:
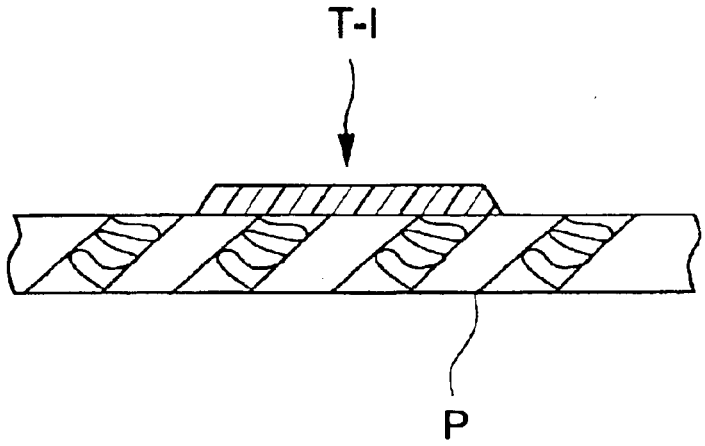
FIG. 15A is a sectional view showing an example of a state where an unfixed image (which may be referred to as toner image, T-I) is provided on an upper surface of the transfer paper "P"
Figure 15B:
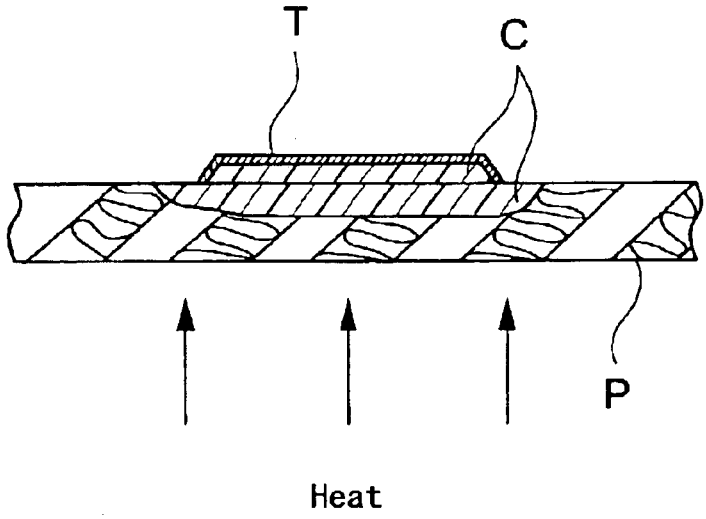
FIG. 15B is a sectional view showing an example of a state of a liquid developer according to the present invention, which forms an image when heated from a direction of a back surface of the transfer paper "P"

FIGS. 15A and 15B show this situation. The amount of carrier liquid penetrating into the transfer paper P depends on the quality of the paper. Compared with regular copy paper, less carrier liquid penetrates into surface-coated paper, and almost all the liquid oozes out on the upper surface of the toner image. In the next step, when the transfer paper P passes between the pair of carrier-removing rollers 337X and 337Z, the carrier liquid oozed out to the upper surface of the toner image is absorbed by the absorbent material which forms the surface of the carrier-removing rollers. The carrier-removing rollers are designed to easily absorb the carrier liquid, wherein one of the carrier-removing rollers acts as a pressure roller against the other, and the transfer paper P is pressurized by both of the carrier-removing rollers 337X and 337Z. The carrier liquid absorbed by the pair of carrier-removing rollers 337X and 337Z is collected by the cleaning units 343X and 343Z attached to each of the carrier-removing roller 337X and 337Z. Accordingly, the capacity of the absorption of the pair of carrier-removing rollers 337X and 337Z can be maintained. Additionally, the carrier liquid collected by the cleaning units 343X and 343Z is kept almost clean, and is available for reuse.

Then, the toner image on both sides of the transfer paper P is completely fixed after the paper is transported through the gap between the pair of fixing rollers 360X and 360Z.

A conventional image-fixing apparatus which has no carrier-remover 330 requires heating temperature of 180° C. to 200° C., or higher, so as to perform high-speed printing. On the other hand, it has been recognized that a temperature of about 120° C. at the pair of fixing rollers 360X and 360Z is high enough to obtain good image-fixing properties when the carrier-remover 330 is installed as described in the present invention. This is due to the configuration of the rollers, which makes it possible to heat both sides of the transfer paper at the same time, efficiently increasing the temperature of the transfer paper during fixing, in addition to the effect of removing excess carrier liquid by the carrier-remover 330. Therefore, it is possible to fix the toner image well, even if the temperature of the pair of fixing rollers 360X and 360Z is considerably lower than that of a conventional image-fixing apparatus. As described in this Example, the preset invention provides excellent features such as saving power consumption drastically in addition to improving high-speed copying.

The roller configuration shown in FIG. 14 allows the transfer paper P to be transported straight, resulting in improved transporting capability of transfer paper and preventing papers from jamming inside the apparatus. Moreover, it is possible to carry out each of the three steps of oozing out the carrier liquid, removing the carrier liquid, and heat fixing, resulting in improved reliability.

Furthermore, the pre-heater 310 in which the solvent oozes out, the carrier-remover 330 in which the solvent is removed, and the heat-fixer 350 in which the image is fixed by heat, are each arranged on both sides of the transfer paper in the same part of the path on which the paper is transported. Three steps for fixing an image, namely carrier oozing out, removal, and heat fixing, can be carried out at the same time on the both sides of a transfer paper. Thus the time to fix images can be shortened compared with the case where fixing both sides of the paper is carried out separately.

When the image-fixing apparatus 300 is turned off for a long time, there is a possibility that the carrier liquid absorbed by the blotter belt 340X and 340Z moves down gradually because of gravity and finally drips the carrier liquid down right beneath the carrier-remover, resulting in some problems such as contamination. To deal with this problem, in EXAMPLE 5 as shown in FIG. 14, at least cleaning unit 343Z of cleaning units 343X and 343Z should be placed at a lower position according to gravity. That is, one of the cleaning units 343X and 343Z is placed under one of the blotter belts 340X and 340Z. Here, the one of the cleaning units is placed right under the blotter belt 340Z, so as to collect the carrier-liquid from the blotter belt 340Z. With this configuration, the excess carrier liquid can be successfully received from the blotter belts 340X and 340Z, even if the apparatus has been turned off for a long period of time. The contamination by the carrier liquid can also be avoided, accordingly. The cleaning units 343X and 343Z may be any one of blade-type and roller-type.

Example 6

One example of an image forming apparatus will be described as follows.

Figure 16:
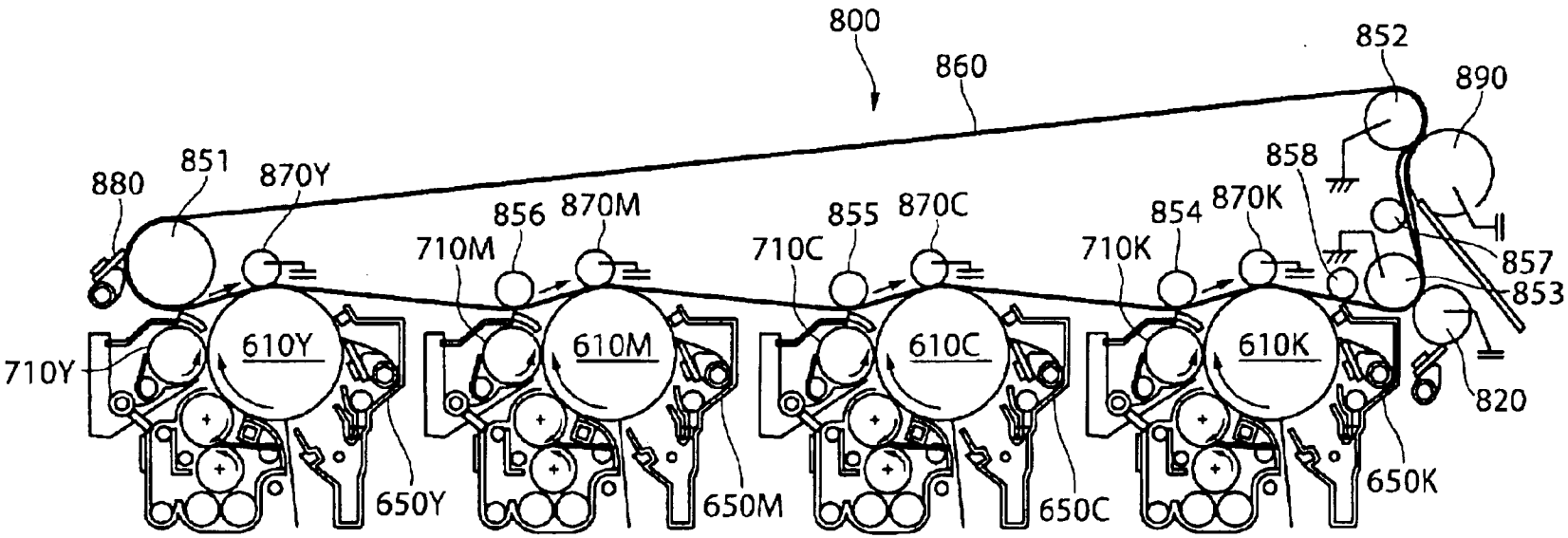
FIG. 16 is a schematic diagram showing an example of a printer used in EXAMPLE 6 of the present invention.

FIG. 16 is a schematic diagram of a printer as an example of an image-forming apparatus in the present invention. This printer includes image-developers having each a sweep roller between the developing roller 21 and the intermediate transfer 14 of FIG. 1, and the image-developers for each of the colors are arranged parallel to a surface of an intermediate transfer belt 860 of FIG. 16. Each image having different colors is sequentially primarily transferred onto the intermediate transfer belt 860, so as to form a full-color image on the surface of the intermediate transfer belt 860. The full-color image is then transferred onto the transfer paper "P" by a primary transferring roller 890. The sweep rollers that closely face the photoconductor drums 610Y, M, C, and K, each of which serves as a latent electrostatic image support, was only one in EXAMPLE 6, however, two of the sweep rollers can be placed.

An explanation of the configuration of the image-developers will be omitted because it is the same as that in the above-mentioned example, and the attached sweep roller will be instead explained. An electric field generates at the nip parts of the photoconductor drum 610Y, M, C, and K and sweep rollers 710Y, M, C, and K by applying a voltage between the sweep rollers 710*a* and 710*b*.

The electric field compresses the toner fine particles on the photoconductor drums 610Y, M, C, and K, and maintains the toner fine particles on the photoconductor drums 610Y, M, C, and K, so as not to peel or separate the toner fine particles. The electric field also attracts the liquid developer on non-image part of the photoconductor drums 610Y, M, C, and K towards a portion closer to the seep rollers 710Y, M, C, and K, so as to collect the liquid developer. Accordingly, excess carrier liquid can be successfully removed and collected. In addition, excess toner fine particles, which were slightly disposed on the non-image part of the photoconductor drums 610Y, M, C, and K, could also be collected. When the image-forming apparatus has two sweep rollers, 450 V of electric field was applied to a first sweep rollers 710Y, M, C, and K, and 500 V of the electric field was applied to a second sweep rollers. The first sweep rollers 710Y, M, C, and K attracts the liquid developer on the non-image part of the photoconductor drums 610Y, M, C, and K. The second sweep rollers receives the carriers disposed on the image part of the photoconductor drums 610Y, M, C, and K, and compresses and retains the toner fine particles on the image-part. In the other words, the bias applied to the second sweep roller 710Y, M, C, and K positively adheres the carrier liquid on the image part of each of the photoconductor drums 610Y, M, C, and K to the second sweep rollers 710Y, M, C, and K, which contributes to an effective removing and collecting the carrier liquid.

A description will be given to the intermediate transfer unit hereinafter. The intermediate transfer unit 800 includes an intermediate transfer belt 860 which is spanned around suspension rollers 851, 852, 853, 854, 855, 856, 857, and 858, a primary transfer bias rollers 870K, 870Y, 870M, and 870C, a cleaning device 880 which has a cleaning blade, and the like.

The intermediate transfer unit 800 also includes a secondary transfer bias roller 890, and a secondary transfer electric resource (not shown) which is connected to the secondary transfer bias roller 890. The intermediate transfer unit 800 further includes a secondary transfer sweep roller 820 which faces the intermediate transfer belt 860. The secondary transfer sweep roller 820 serves as a removing member which removes a solvent on the intermediate transfer belt 860, prior to a secondary transferring step.

Detailed description will be given to the intermediate transfer belt 860, the primary transfer bias rollers 870Y, M, C, and K, the secondary transfer bias roller 890. The intermediate transfer belt 860 is spanned so as to give a desirable tension to suspension rollers 851, 852, 853, 854, 855, and 856, and also to the photoconductor drums 610K, 610Y, 610M, and 610C. The intermediate transfer belt rotates counter clockwise. The electric charge for primary transfer is given in a structure as follows. The primary transfer bias roller 870 faces the photoconductor drum 610K, and the intermediate transfer 860 is disposed between the primary transfer bias roller 870 and the photoconductor drum 610K. The primary transfer bias roller 870K also works as an electrode that gives a desirable transfer bias from the primary transfer bias electric source (not shown). The secondary transfer bias roller 890 is disposed, facing a portion between the suspension rollers 852 and 857. The secondary transfer bias roller 890 also works as an electrode that gives a desirable transfer bias from the secondary transfer bias electric source (not shown).

The suspension roller 853 closely faces the intermediate transfer sweep roller 820. The suspension roller 853 grounds the intermediate transfer belt 860 which is disposed between the suspension roller 853 and the intermediate transfer weep roller 820. A bias is applied to the intermediate transfer sweep roller 820 by elimination electrode (not shown). The bias is applied to the intermediate transfer sweep roller so that the toner fine particles are compressed to the intermediate transfer belt 860. The intermediate transfer sweep roller 820 is disposed in an area where the suspension rollers 857 and 858 each face, so as to provide a different electric field from those generated in the primary transfer nip part or the secondary transfer nip part.

In EXAMPLE 6, the suspension roller 853 needed to be grounded so that the primary transfer bias did not affect the primary transfer bias. The bias needed to be applied to the intermediate transfer sweep roller 820.

The photoconductor drum 610K, which serves as a latent electrostatic image support, having a toner image on a surface thereof rotates, and the toner image is transferred to the primary transfer nip part where the photoconductor drum 610K closely faces the intermediate transfer belt 860. Thereafter, in the primary transfer nip part, a bias, which is negative bias having an adverse bias of the positive toner fine particles, is applied through a back side of the intermediate transfer belt 860, for example in −300 V to −500 V. The electric field generated by the application attracts the liquid developer of the toner image on the photoconductor drum 610K, and the toner image is then transferred onto the intermediate transfer belt 860 (primary transfer). For forming a full-color image, a yellow-liquid developer, magenta-liquid developer, cyan-liquid developer, black-liquid developer is sequentially provided in this order, so as to form a monochromic toner image of each of the colors onto the intermediate transfer belt 860 to form a full-color image, consequently.

The printer of the EXAMPLE 6 secondly transfers the primarily transferred monochromic images on the intermediate transfer belt 860 to a transfer paper "P" at once. The secondary transfer enables reducing the amount of carrier liquid, compared to direct-transferring where the monochromic toner images on the photoconductor drums 610K, C, M, and Y, each of which serves as a latent electrostatic image support, are directly transferred onto the transfer paper "P." The station of a first color (may be referred to as first station, hereinafter), a first color of one of the monochromic toner image contacts "dried" intermediated transfer belt 860. Therefore, more carrier liquid is transferred. The stations of the second and the following colors also enables reducing the deposition of the carrier liquid, because the intermediate transfer belt 860 receives the monochromic toner images in wet state. It is well-known that the amount of the carrier liquid is different between a portion that colors are superimposed and a portion that colors are not superimposed. The intermediate transfer sweep roller 820 compresses toner fine particles onto the intermediate transfer belt 860, so as to remove the carrier liquid. The weight concentration of the toner fine particles in the liquid developer also increases, accordingly.

TABLE 7

| Amount of Deposition of the Carrier liquid | First Station mg/cm$^2$ | Second Station mg/cm$^2$ | Third Station mg/cm$^2$ | Fourth Station mg/cm$^2$ |
|---|---|---|---|---|
| On photoconductor drum (latent electrostatic image support) before primary transfer | 0.49 | 0.15 | 0.15 | 0.15 |
| On intermediate transfer | 0.41 | 0.41 + 0.073 = 0.483 | 0.483 + 0.036 = 0.519 | 0.519+ 0.018 = 0.537 |

TABLE 7 shows a change in the deposition amount of the liquid developer on the intermediate transfer belt 860 for each of the stations, in a case that only does the first station have a toner image, and the other stations have no toner images. The liquid developer Al was used for the measurement. 100% of the toner fine particles are transferred from a photoconductor drum serving as a latent electrostatic image to the intermediate transfer belt 860. 95% of the toner image is still maintained on the photoconductor drum serving as a latent electrostatic image support, even if 100% of the toner image is developed. It can be estimated that the weight concentration of the toner fine particles in the liquid developer of the toner image on the intermediate transfer belt 860 after transferring at 4 of the stations is 21%.

The intermediate transfer sweep roller 820 of the EXAMPLE 6 removed 0.15 mg/cm$^2$ of the carrier liquid from a toner image after the primary transfer. The toner image after passing through the nip part formed between the intermediate transfer sweep roller 820 and the intermediate transfer belt 820 had a weight concentration of the toner fine particles in the liquid developer of 29%.

Then, the intermediate transfer belt 860, on which a full-color image is transferred, is driven to move the full-color image towards the secondary transfer nip part, where the intermediate transfer belt 860 faces the transfer paper "P" as a recording medium, and the transfer paper "P" is transported from a paper-feeder (not shown) in the direction of the arrow by the intermediate transfer belt. At the secondary transfer nip part, a negative bias voltage, for example from −800 to −2000 V, is applied to the reverse face of the transfer paper "P" through a secondary transfer bias roller 890 as the secondary transfer, or a pressure of 50 N/cm$^2$ or so may be applied.

The application of bias and the pressure enables the liquid developer on the intermediate transfer belt 860 to be attracted to the transfer paper "P" and the toner image is then transferred onto the transfer paper "P" at once (secondary transfer). In the EXAMPLE 6, the secondary transfer bias roller 890 was used as a roller to pressurize the intermediate transfer belt 860, together with suspension rollers 852 and 857. A roller that faces the secondary transfer bias roller 890 and the others can also be installed so as to receive the pressure.

Figure 17:
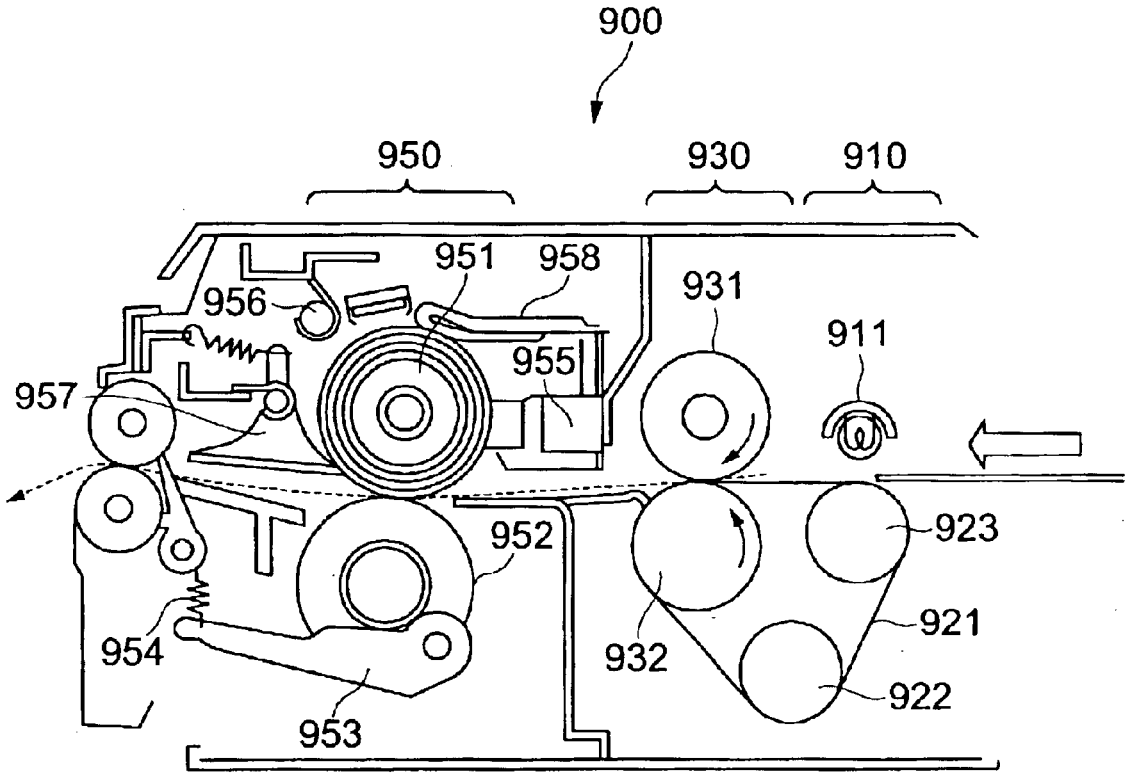
FIG. 17 is a schematic diagram showing an example of an image-fixing apparatus of the printer used in EXAMPLE 6 of the present invention.

Thereafter, a transfer paper "P" having an image (unfixed image) is separated from the intermediate transfer belt 860 by a separator (not shown), and is then transported to the image-fixing unit 900 in FIG. 17. The transfer paper "P" is ejected from the image-forming apparatus after heated in the image-fixing unit 900. The residual charges on the photoconductor drums 610Y, M, C, and K, each of which serves as a latent electrostatic image support, are eliminated by a charge-eliminator. The surfaces of the photoconductor drums 610Y, M, C, and K are cleaned by a cleaning deices 650Y, M, C, and K. The liquid developer that was not developed are collected and removed, so as to be reused in the next image-forming.

In the EXAMPLE 6, only one of the intermediate transfer sweep roller 820 was installed. Two or more of the intermediate transfer sweep roller can also be installed.

Moreover, the configurations of the intermediate transfer belt 860 is so arranged not to generate transfer error by introducing the elastic body. The intermediate transfer belt 860 also comprises a nylon string or steel string so as not to elongate the intermediate transfer belt 860 to a direction that it rotates. The nylon string or the steel string may have a diameter of 50 $\mu$m to 400 $\mu$m.

In the EXAMPLE 6, the carrier liquid can also be removed from an unfixed image (secondly transferred image) on the transfer paper "P."

FIG. 17 is a schematic drawing of the image-fixing unit of EXAMPLE 6. This image-fixing apparatus 900 includes the following parts, in the direction of travel of the transfer paper P, from upstream (right-hand of the figure) to downstream (left-hand of the figure). That is, pre-heater 910 as the solvent-oozer, carrier-remover 930 as the carrier-remover, and the heat-fixer 950 as the heat-fixer.

The heat-fixer 950 includes the heating roller 951 and the pressurizing roller 952 so that both of the rollers contact and pressurize each other. A heater is built into the heating roller 951, and a rubber layer, an oil-proof layer (silicone rubber fluoride layer), and an RTV silicone rubber layer or Teflon layer are formed in this order to have a desirable thickness on the surface of the mandrel of the heating roller 951. On the other hand, the pressurizing roller 952 is formed of a silicone rubber coated by Teflon. Thermoistor 955 and temperature fuse 956 are arranged around the heating roller 951, and are used to control temperature. The separation nail 957 and the cleaning blade are set at the surface of the heat roller 951.

The above-mentioned pre-heater 910 includes the pre-heating heater 911 that heat the toner image on the transfer paper "P."

The pre-heating heater 911 may be a halogen lamp or an infrared ray heater. The pre-heating heater 911 preferably provide a condensed radiation.

The above-mentioned carrier-remover 930 is located between the pre-heater 910 and the heat-fixer 950 in a direction that the transfer paper is transported. The carrier-remover 930 includes the carrier-removing roller 931 as the solvent-remover which removes the carrier liquid oozed out to the surface of the toner image by heating in the pre-heater 910. Additionally, back-up roller 932 is also installed as a pressurizer which presses the surface of the toner image against the carrier-removing roller 931. The cleaning blade (not shown) is attached to the carrier-removing roller 931 to remove and collect excess carrier liquid from the transfer paper P, and to make it possible for the carrier-removing roller 931 without adhering carrier liquid to always touch the surface of the image of the transfer paper P. Additionally, the above-mentioned carrier-removing roller 931 consists of a surface material that does not absorb or contain the carrier liquid. Moreover, the transport belt 921 is spanned around the drive roller 922, the suspending roller 923, and back-up roller 932, and driven. The transfer paper P is transported by the transport belt 921 as shown in the figure, heated by the pre-heating heater 911, while the transfer paper P is passing under the pre-heating heater 911. During this, the carrier liquid inside the toner layer oozes out. The transfer paper P is transported as is by the transport belt 921 to the carrier-remover 930.

Next, the image-fixing process using the above-mentioned image-fixing apparatus 900 will be described. The unfixed image on transfer paper P first reaches the pre-heater 910 when it enters the image-fixing unit 900 after separating from the intermediate transfer belt 860 by a separation apparatus. At this time, the toner image on the transfer paper P is heated by the heater. The carrier liquid in the liquid developer oozes out to the surface of the transfer paper P.

The transfer paper P with oozed out carrier liquid on a surface thereof is transported next to the carrier-remover 930. In the carrier-remover 930, the carrier-removing roller 931 contacts the oozed out carrier liquid on top of the surface of the transfer paper P, and the transfer paper P passes by being pressed against the carrier-removing roller 931 from the reverse face of the transfer paper P by the back-up roller 932. At this time, the oozed out carrier liquid is attracted to a portion closer to the carrier-removing roller 931. The carrier-removing roller 931 removes the oozed out carrier liquid from the transfer paper P.

The transfer paper P, after having the oozed out carrier liquid removed therefrom, is further transported to enter the heat-fixer 950. In the heat-fixer 950, the transfer paper P passes the fix nip part where the heat roller closely faces the upper surface of the transfer paper P, which is the surface carrying the image, and a pressurizing roller which presses the transfer paper P against the heating roller from the reverse face of the paper. In this step, the unfixed image is fixed onto the transfer paper P by heat and pressure. Then, the transfer paper P is ejected from the image-fixing unit 900.

90% of the toner image on the intermediate transfer belt 860 is secondly transferred to the transfer paper P at the secondary transfer nip part. Therefore, about 0.04 mg/cm$^2$ of the carrier liquid remains on the surface of the intermediate transfer belt 860. As shown in TABLE 8, 0.35 mg/cm$^2$ of carrier liquid adheres to the toner image on the transfer paper P after the secondary transfer. In this case, the weight concentration of the toner fine particles in the liquid developer disposed on the toner image on the transfer paper P was 29%.

While the transfer paper P passes a nip part where the transfer paper P faces the carrier-removing roller 931, 0.03 mg/cm$^2$ of carrier liquid is removed by the carrier-removing roller 931, and the toner fine particles remained on the transfer paper P. At this time, the weight concentration of the toner fine particles disposed on the toner image on the transfer paper P was 32%.

TABLE 8 shows the amount of carrier liquid adhering to the toner image from the primary transfer to the carrier removing by the carrier-removing roller 931.

TABLE 8

| | On intermediate transfer after the primary transfer | Intermediate transfer after sweep roller | On the recording medium (transfer paper) type 6200 | On the recording medium (transfer paper) after carrier-removing roller |
|---|---|---|---|---|
| Carrier Liquid adhering to the toner image (mg/cm$^2$) | 0.537 | 0.387 | 0.35 | 0.32 |
| Weight concentration of the toner fine particles in the liquid developer on the toner image | 21% by weight | 29% by weight | 29% by weight | 32% by weight |

Even when a non-volatile is included in the carrier liquid of the liquid developer, it can be removed in advance by the carrier-removing roller 931 in the above-mentioned image-fixing unit 900. The unfixed image can be firmly fixed on the transfer paper P, thus heat-fixing can be performed well.

Additionally, because the carrier liquid is removed, the heat-fixing temperature can be decreased compared with the conventional steps. Moreover, the heating temperature at the heat-fixer 950 can be decreased compared with the fixing step using one-step heating because the toner image is heated at the pre-heater 910 prior to the heat-fixing step. For instance, the temperature control may be carried out with the following technique; thermal sensors are provided in the pre-heater and heat-fixer to detect temperatures and accomplish ON-OFF control according to the detected results of the thermal sensors, controlling the temperature of the pre-heater and heat-fixer at the desired temperatures. In the EXAMPLE 6, the temperature of the pre-heating roller 911 of the pre-heater 910 was controlled to be 100° C. to 150° C., while it was controlled to be 100° C. to 120° C. at the heating roller of the heat-fixer 950, resulting in excellent fixed images. Therefore, it is possible to shorten the heating and fixing time. Additionally, because the EXAMPLE 6 used a roller-shaped carrier-removing roller 931 for the carrier removing member 930, it can be made in smaller than one having a belt or web-shape and it will be an advantage to make the image-fixing unit 900 smaller.

The results of the Examples on a weight concentration of the toner fine particles in the liquid developer and the image-fixing properties on the transfer paper P will be provided. The image-fixing properties were measured by a smear tester (friction tester, type I, JISLO823). The test was carried out in the following way; a white cotton cloth (approval number, JISL0803) is attached on the tester and the image rubbed ten times with a reciprocating motion, and then the image concentration was detected by measuring the reflection image concentration of the white cloth using the reflection image concentration meter. The image concentration of white cloth without adhesion is subtracted from the measured reflection concentration, and dividing this value by the image concentration on the recording medium before rubbing produces a value which is defined as the image-fixing properties. In this procedure the image concentration on the recording medium before rubbing is calculated by subtracting the image concentration of the recording medium without toner adhesion. The image-fixing properties value of 0.1 shows excellent image-fixing properties. On the other hand, in the case of an image-fixing properties value of 0.4, the toner image can be peeled off only by rubbing by hand. It is hard to say that there is good image-fixing properties in this case.

The test for image-fixing properties in the EXAMPLE 6 employed the liquid developer A1 and the liquid developer D. The amount of the carrier liquid was changed so as to have the same amount of the solids of the toner fine particles. "type 6200" produced by Ricoh Company, Ltd., was used as the transfer paper "P."

Figure 18:
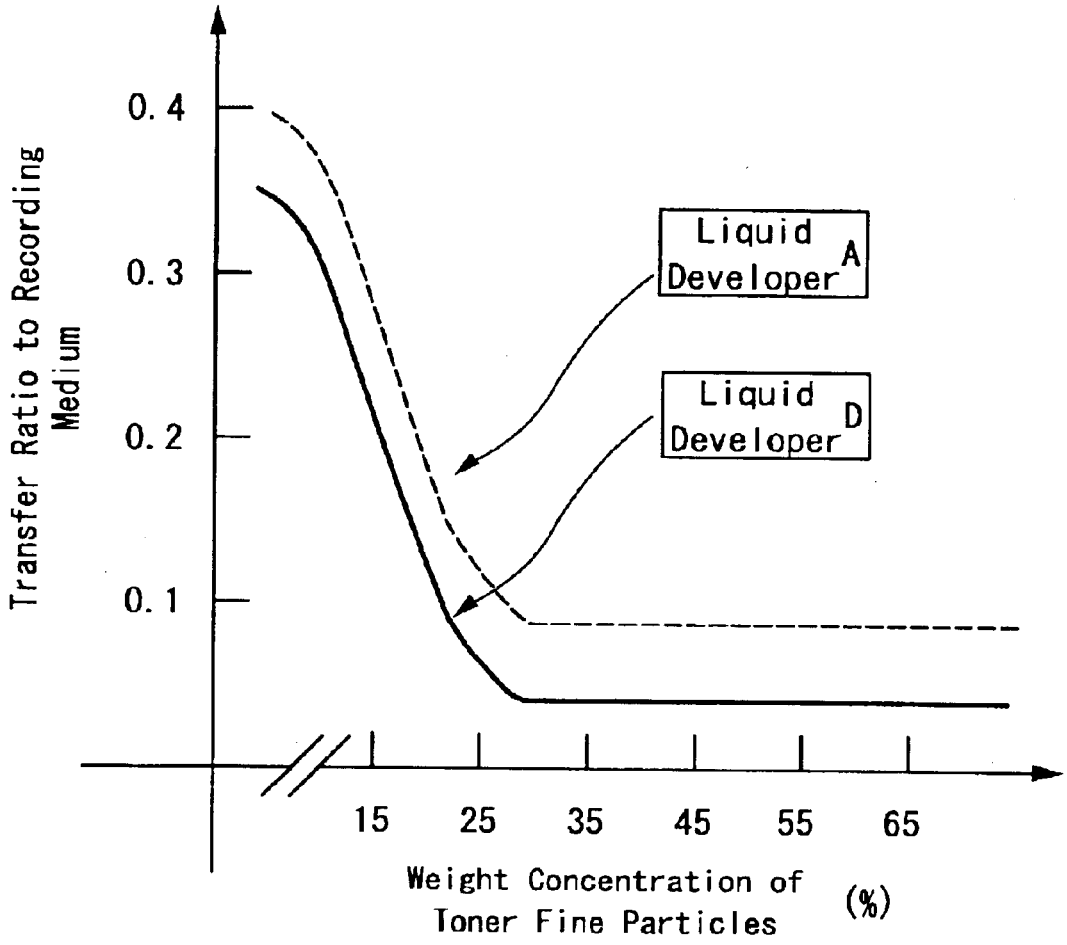
FIG. 18 is a graph showing a relationship between the concentration of the liquid developer and the image-fixing properties of the liquid developer of the present invention to a transfer paper "P."

FIG. 18 shows the results of the image-fixing properties to the transfer paper P relative to the weight concentration of the toner fine particles in the liquid developer. It can be found out that the image-fixing properties was improved as the value for the image-fixing decreases and the weight concentration of the toner fine particles in the liquid developer increases. On the other hand, the value of the image-fixing increases as the weight concentration of the toner fine particles in the liquid developer decreases. It is also apparent that the value of the image-fixing rapidly increases at the weight concentration of the toner fine particles in the liquid developer of 25% by weight, which shows that image-fixing properties deteriorates. It can said that the unfixed image can be sufficiently fixed when the weight concentration of the toner fine particles in the liquid developer 25% by weight or more, and more preferably of 30% by weight or more.

Using a liquid developer in which toner fine particles are surrounded by or adhered to a dispersing resin, the adhesion force among the toner fine particles and the image-fixing to the recording medium generally deteriorate. However, with the liquid developer D of the EXAMPLE 6 enables separating the toner fine particles from the dispersing resin. The dispersing resin separated from the toner fine particles dissolves in the carrier liquid. The dispersing resin in the carrier liquid can be removed from a toner image by a carrier-removing roller. Accordingly, the graph shifts as shown in FIG. 18, whcich provided a further better image-fixing properties.

In the EXAMPLE 6, the weight concentration of the toner fine particles on the image part immediately after secondly transferring the toner image was 29% and was entering a region already obtaining excellent image-fixing properties. However, if the weight concentration of the toner fine particles becomes lower than 25% after the secondary transfer and the paper reaches to the fix nip part, the image-fixing properties become worse.

However, when the step to remove the carrier liquid from the transfer paper P is included as shown in the EXAMPLE 6, good image-fixing properties can be obtained by removing the carrier liquid prior to entering the fix nip part.

Lower weight concentration of the toner fine particles during transfer is preferable to improve the transfer property of an image, and a high weight concentration of the toner fine particles during fixing to improve the image-fixing properties. The image-fixing unit shown in EXAMPLE 6 can accept the contradiction between the high weight concentration of the toner fine particles and the low weight concentration of the toner fine particles. This is because the image-fixing unit did not remove the carrier liquid until the transfer paper reached the secondary transfer nip part, and the image-fixing unit can fix the toner image after removing the carrier liquid on the transfer paper P.

The EXAMPLE 6 has only one carrier-removing roller 931 on the transfer paper P. Two or more carrier-removing rollers may also be installed. By utilizing two or more carrier-removing rollers, one can remove a larger amount of carrier liquid as compared with a single carrier-removing roller. Therefore, the unfixed image formed on a transfer paper P can be fixed by heating even when the transfer paper P is made of a material that is hard for the carrier liquid to penetrate thereinto. As a result, it allows the image-fixing apparatus 900, to accommodate a wide variety of transfer papers P.

Additionally, the carrier removing belt formed of a belt which is formed of a carrier removing member. Resin films made by polyimide or polycarbonate, materials that do not swell in the carrier liquid and have heat-resistances can be used as the carrier-removing belt. One may also install a cleaning unit to clean the surface of the carrier removing belt and arrange them to collect the carrier liquid removed from the belt surface.

Materials that do not absorb or impregnate the carrier liquid were used for the carrier-removing roller 931 in EXAMPLE 6. Instead of these, porous materials that impregnate and absorb are also acceptable. For instance, the carrier-removing roller may have web on a surface thereof. In this case, once the web is used, the used web is reeled to a reeling member. The web is replaced when the web is completely reeled.

Heating and pressurizing were employed as a fixer in the image-fixing apparatus in EXAMPLE 6. However, it is to be understood that the fixer employed in the present invention to improve the image-fixing properties is not limited to the specific example. For instance, the present invention may be used as a fixer, in which the image-fixing properties deteriorate when a large amount of carrier liquid is contained in the liquid developer which forms an unfixed image. Examples include press fixing, solvent fixing, and the like.

According to EXAMPLE 5 mentioned above, one can sufficiently fix an image formed by the liquid developer, which is of toner fine particles dispersed in the solvent, wherein a part or all of the solvent is nonvolatile.

Additionally, the heat-fixer 950 is installed as the heat-fixer to fix the unfixed image by heat on the transfer paper P (recording medium) after removing the solvent by the carrier remover 930 as the solvent-remover. Therefore, excellent fix can be assured because the unfixed image is heated and fixed after removing the nonvolatile solvent, and there is another excellent advantage that enables one to achieve higher-speed fixing than a fixing device comprising conventional liquid developer provides. This is because the unfixed image is heated and fixed by the heat-fixer after removing the nonvolatile solvent, a factor presenting obstacles to the heat-fixing of the unfixed image.

Moreover, there is an example, wherein the cleaning unit 343Z in FIG. 14 is placed according to gravity underneath the removing roller or removing belt mentioned above as the collection device at the lower position, so as to collect the aforementioned oozed out solvent. The following solvents, which were transferred to the solvent removing parts such as the removing roller and removing belt, are collected by collectors in the low position. These solvents are those that are placed at a lower position according to gravity and those that are originally placed somewhere not in a lower position according to gravity, but move to a lower position according to gravity. The device permits the collection of solvent even when the removed solvent almost drips from a lower position of the solvent removing part according to gravity because the device operation is turned off for a long time. Thus, contamination of the inside of apparatus by the solvent can be avoided because the removed solvent almost dripping from a lower position of the solvent removal part according to gravity can be collected.

In the above-mentioned EXAMPLE 5, the removing roller, removing belt and web consist of porous material such as nonwoven fabric and elastic materials, which have ability to absorb and swell, such as silicone rubber. Herein, either porous material such as nonwoven fabric or elastic materials such as silicone rubber having ability to absorb and swell can be used as the removing roller and removing belt. Porous materials such as nonwoven fabric can be used as the web. Because those materials can remove the oozed out solvent, the device attains excellent image-fixing properties and higher-speed fixing than the solvent-removers which are not formed of these materials. Using these porous materials and elastic materials as the removing roller, removing belt or web allows efficient removal of the oozed out solvent compared with the solvent-removers which are not formed of these materials.

In the above EXAMPLE 5, materials which do not have the ability to absorb and swell are at least used as the surface of the carrier-removing roller and carrier removing belt as the solvent-removers. Therefore, the removing roller and removing belt become more durable than ones formed of materials that have ability to absorb and swell. This is because the pressure applied to the material of the removing roller and removing belt is relieved, since it does not absorb the solvent and swell. Therefore, it has excellent durability, more than that of materials with the ability to absorb and swell, thus saving expendable parts. Additionally, the collected solvent (oozed out carrier liquid) can be easily taken from the surface of the solvent-removers, resulting in excellent high-speed fixing. The removed carrier liquid can be cleaned efficiently because the carrier-removing roller and carrier removing belt are made of materials that do not swell in the solvent. Moreover, there are examples employing a configuration with two or more of the removing rollers, removing belts, and/or web. The configuration allows removing more solvent (oozed out carrier liquid), compared with the system employing only one removing roller, removing belt, and/or web, therefore heat-fixing of unfixed image formed on the recording medium (transfer paper) with low solvent penetration characteristics can be used. This is because the oozed out solvent (carrier liquid) is removed in multiple steps, using the removing roller, removing belt, and/or web. As a result, the variety of recording medium that is available to attain excellent fixing is broadened from the viewpoint of range of solvent penetration, and many kinds of recording medium (transfer paper) can be available.

Back-up rollers as the presssurizers which presses the image holding surface against the aforementioned removing roller, removing belt, and/or web are placed and driven as follows. That is, the contact surface of the removing roller, removing belt, and web with the recording medium and the contact surface of the back-up rollers with the reverse face of the recording medium are driven on almost same line in the direction that the recording medium is transported.

This configuration does not stress the toner image on the recording medium, thereby preventing image error. This is because the oozed out solvent is removed by transporting the recording medium pinched between the back-up roller and removing roller, removing belt, or web, which are driven on almost the same line as the direction of travel of the recording medium. This system allows avoiding the potential stress applied to the image on the recording medium when the speed of each part pinching from both sides is different.

The aforementioned recording traveling speed can be controlled to be same at the pre-heater 310 in FIG. 14 as the solvent oozing out position, the carrier-remover as the solvent removal position, and heat-fixer as the heat-fixing position. The configuration does not apply stress or pressure to the image on the recording medium caused by the variation in the speed, thereby preventing jamming the recording medium and forming image error. Because the recording medium is transported at the constant speed through the all positions of the solvent oozing out position, solvent removing position, and heat-fixing position.

There is an example, wherein the heat-fixer 350 in FIG. 14 as the heat-fixer to heat and fix the unfixed image onto the recording medium, and all positions of the solvent oozing out position, solvent removing position, and heat-fixing position are placed on a straight line along with the direction that the recording medium is transported. This configuration allows passing the recording medium through the solvent precipitating position, solvent removing position, and heat-fixing position without applying a carrying stress, thus improving the carrying ability of the recording medium, and conducting with precision each process of solvent precipitation, solvent removal, and heat-fixing. This is because this configuration allows the surface image to pass the solvent precipitation position, solvent removal position, and heat-fixing position while the recording medium is traveling in a straight-line. Therefore, the recording medium passes the solvent oozing out position, solvent removing position, and heat-fixing position without stress being applied by nonlinear transport.

A material with low coefficient of surface friction is coated on the pre-heat roller as the contact-heating part of the solvent-oozers. Therefore, solvent can ooze out without unnecessary stress against the unfixed image formed on the recording media.

Additionally, in the above-mentioned EXAMPLE 5, images to be processed by the following three steps as follows are formed on both sides of the recording medium; pre-heating by solvent-oozer, removing the oozed out solvent by the solvent-remover, and heating and fixing by the heat-fixer. Therefore, even when images are formed on both sides of the recording medium, excellent fixing of the toner image can be assured and high-speed fixing is possible, compared with the conventional image-fixing apparatus. Double-sided fixing of an unfixed image formed in duplex on the recording media is completed while the recording media passes once through the three steps, solvent-oozing out in the liquid developer, removing the oozed out solvent, and heating and fixing.

Additionally, in EXAMPLE 5, a contact surface of the removing roller or removing belt with the recording medium, wherein these removing devices are placed so as to pinch the recording media from both sides, are driven at almost the constant speed in the direction of transporting the recording medium.

Furthermore, the oozed out solvent is removed by transporting the recording medium pinched between the removing roller and the removing belt which is driven at almost the same speed in the direction of transporting the recording medium. Because of this system, it is not necessary to install a back-up roller against the removing roller or the removing belt placed on both sides of the recording medium, simplifying the structure of the image-fixing apparatus. Additionally, it is not necessary to install carrier structures for the recording medium. Moreover, an unnecessary large stress is not applied to the unfixed image formed on the recording medium because the traveling speed of the driving parts pinching them is almost the same in the direction of transporting the recording medium.

In the above-mentioned EXAMPLE 5, the positions of solvent oozing out, solvent removing, and heating and fixing are arranged to be at the same position in the transporting path of the recording medium on each side of the recording medium. That is, solvent oozing out, removing the oozed out solvent and heating and fixing the unfixed image on the recording medium are carried out, respectively, on both sides of the recording medium at the same position in the transporting path of the recording medium. Thus, the image-fixing apparatus fixes the images formed on the both sides of the recording medium, the time for image fixing is the same as that for single-sided image-forming, even if the image is formed on the recording medium in duplex. The length of the transporting path for the recording medium to fix the image can be built to be the same as that for single-sided image-forming, thereby avoiding scale-up of the apparatus caused by extending the transporting path.

Additionally, in EXAMPLE 5, a driving switch device may be placed as solvent removal level switcher which switches the degree of solvent removal by the solvent-remover depending on the kind of recording medium. More specifically, because it is not necessary to remove the solvent when the recording medium is made of a material easily penetrating the solvent, the solvent removal level switcher may stop removing the solvent. On the other hand, because active solvent removing is required for a recording medium formed of a material difficult to absorb the solvent, the degree of the solvent removing should be switched to maximize solvent removing ability using the solvent removal level switcher. Moreover, if the solvent penetration degree of the recording medium presents between the aforementioned two materials, the solvent removal level switcher would be switched to select a level from the predetermined solvent removing levels. Because this device allows switching the degree of solvent removal depending on the kind of recording medium, the solvent-remover may be used as needed which helps the solvent-remover have a longer life, compared with one working constantly. Additionally, this device allows switching the degree of solvent removing depending on the properties of the recording medium, obtaining excellent fixed images all the time. Moreover, because the operation of the solvent removers can be paused when it is not necessary, the energy cost can be reduced compared with one working constantly. The device configuration for switching the degree of solvent removal may be designed to be operated manually and be automatically switched by installing a sensor in the device to detect the solution penetration.

Furthermore, according to EXAMPLE 5 mentioned above, one can sufficiently fix an image formed by the liquid developer, which is formed of toner fine particles dispersed in the solvent, wherein a part or all of the solvent is nonvolatile.

The device realizes high-speed fixing, resulting in excellent image-fixing even if the images are continuously formed at a high speed.

According to the above-mentioned EXAMPLE 6, the carrier liquid is removed at two portions on top of the photoconductor drum 610 serving as a latent electrostatic image support, or other two portions on top of the intermediate transfer belt 860 and the transfer paper P. Therefore, the carrier liquid of the liquid developer can be removed completely prior to fixing the image, resulting in improved image-fixing properties of the image.

Additionally, according to EXAMPLE 6, the image could be fixed excellently to the transfer paper P showing the result in FIG. 18, because the weight concentration of the toner fine particles in the liquid developer at the fix nip part was 25% by weight or higher.

Moreover in EXAMPLE 6, the developing agent and carrier removed by the first sweep roller 710*a* and the second sweep roller 710*b* were removed through each roller by cleaning blades 711*a* and 711*b*. This operation allowed the surface of the first sweep roller 710*a* and the second sweep roller 710*b* to be used for collecting the liquid developer and the toner fine particles. Therefore, removing the carrier liquid disposed to the image part of the photoconductor drum 610 serving as a latent electrostatic image support and the liquid developer on the non-image part of the photoconductor drum serving as a latent electrostatic image support can be carried out excellently and continuously.

The carrier liquid of the image part on the intermediate transfer belt 860 is attached and removed by an electric field generated by the intermediate sweep roller 820 applying a certain amount of bias voltage. It allows an increase in the weight concentration of the toner fine particles on the image part on the intermediate transfer prior to the secondary transfer to the transfer paper P, thus obtaining stable image-fixing properties. Additionally, as in EXAMPLE 6, when color images are on the intermediate transfer belt 860, it is possible to collect and remove all of the carrier liquid after laying up the image. Because of this configuration, the carrier liquid can be efficiently removed, compared with a device that removes the carrier liquid one color at a time.

In EXAMPLE 6, the electric field can be applied to the area of the intermediate transfer belt 860 which faces the intermediate transfer sweep roller 820, the primary transfer nip part, and the secondary transfer nip part, independently and individually. That is, different electric fields of the primary transfer bias, removing bias, and the secondary transfer bias can be generated on the same intermediate transfer belt 860, and electrodes of the primary transfer electrode, the secondary transfer electrode, and removing electrode are installed individually. Because of the system, it is possible to attain excellent primary and secondary transfer properties and removing properties of the liquid developer and carrier liquid from the intermediate transfer belt 860.

In EXAMPLE 6, carrier liquid is removed from the image on the transfer paper P by the carrier-removing roller 931. This allows one to obtain excellent image-fixing properties by removing carrier prior to fixing, even if the image formed by a liquid developer which includes a large amount of the carrier liquid is transferred on the transfer paper P. Moreover, according to EXAMPLE 6, the heating temperature of the heat-fixer 950 may be decreased compared with single-step heat fixing because the image is pre-heated prior to the heat-fixing.

What is claimed is:

1. A liquid developer comprising:

an insulating liquid; and toner fine particles containing a coloring agent and a toner resin, wherein the toner fine particles are dispersed in the insulating liquid, and the liquid developer has a specific resistance of $1\times10^6$ Ωcm or more, when a weight concentration of the toner fine particles in the liquid developer is 20% by weight or more, after the liquid developer is concentrated during image-forming.

2. A liquid developer according to claim 1, wherein the liquid developer has the specific resistance of $1\times10^6$ Ωcm or more, when the weight concentration of the toner fine particles in the liquid developer is 50% by weight or more.

3. A liquid developer according to claim 2, wherein the liquid developer has the specific resistance of $1\times10^6$ Ωcm or more, when the weight concentration of the toner fine particles in the liquid developer is 70% by weight or more.

4. A liquid developer according to claim 1, wherein the insulating liquid comprises a dispersing agent which maintains distances among the toner fine particles.

5. A liquid developer according to claim 1, wherein each of the toner fine particles has at least one coating layer.

6. A liquid developer according to claim 1, wherein the coloring agent has at least one coating layer.

7. A liquid developer according to claim 1, wherein the insulating liquid has a viscosity of 0.5 mPa·s to 1000 mPa·s, a specific resistance of $1\times10^{12}$ Ωcm or more, and a surface tension of 30 dyn/cm or less.

8. A liquid developer according to claim 1, wherein the insulating liquid is a nonvolatile liquid in at least a portion thereof, and has a boiling point of 100° C. or higher.

9. A liquid developer according to claim 8, wherein the insulating liquid is a silicone solvent.

10. A liquid developer according to claim 9, wherein the silicone solvent is selected at least from phenylmethylsiloxane, dimethyl (poly)siloxane, and (poly) dimethyl cyclosiloxane.

11. A liquid developer according to claim 9, wherein the insulating liquid comprises a dispersing agent having a silicone group.

12. A liquid developer according to claim 9, wherein each of the toner fine particles has a silicone group on a surface thereof.

13. A liquid developer according to claim 12, wherein each of the toner fine particles has a resin as a coating layer, and the resin has a lower glass transition temperature (Tg) than a glass transition temperature of the toner fine particles.

14. A liquid developer according to claim 13, wherein the silicone group dissociates from each of the toner fine particles, when the toner fine particles are heated during image-fixing.

15. A liquid developer according to claim 8, wherein the insulating liquid forms an unfixed image, and the insulating liquid oozes out of a surface of the unfixed image, when the unfixed image is heated during the image-forming.

16. A liquid developer according to claim 1, wherein the insulating liquid is a volatile liquid.

17. A liquid developer according to claim 1, wherein the toner fine particles have a volume average particle diameter of 0.1 μm to 6 μm, and a weight concentration of the toner fine particles in the liquid developer before the image-forming is 5% by weight to 40% by weight.

18. A liquid developer comprising:

an insulating liquid; and toner fine particles containing a coloring agent and a toner resin, wherein a rate of change of an electric capacitance of the liquid developer is 90% or less in an electric circuit where an electrical double-layer capacitor and an electronic resistance corresponding to a velocity of an electron exchange during an electrode reaction are connected in parallel, and a resistance corresponding to an electric conductivity of the insulating liquid is connected in series, when a weight concentration of the toner fine particles in the liquid developer varies from 20% by weight to 70% by weight during image-forming.

19. An image-fixing apparatus comprising:

a solvent-oozer configured to heat a solvent of a liquid developer which forms an unfixed image, so as to ooze the solvent out of a surface of the unfixed image; and a solvent-remover configured to remove the solvent on the surface of the unfixed image, wherein the liquid developer comprises:

an insulating liquid serving as the solvent; and toner fine particles containing a coloring agent and a toner resin, wherein the toner fine particles are dispersed in the insulating liquid, and the liquid developer has a specific resistance of $1\times10^6$ Ωcm or more, when a weight concentration of the toner fine particles in the liquid developer is 20% by weight or more, after the liquid developer is concentrated during image-forming.

20. An image-fixing apparatus according to claim 19, further comprising:

a heat-fixer configured to heat the unfixed image, so as to fix the unfixed image onto the recording medium, after removing the solvent.

21. An image-forming apparatus comprising:

a latent electrostatic image support configured to have a latent electrostatic image on a surface thereof;

an image-developer configured to supply a liquid developer onto the latent electrostatic image at a development nip part where the image-developer faces the latent electrostatic image support, so as to visualize the latent electrostatic image and to form a visible image;

a transfer configured to transfer the visible image onto a recording medium at a transfer nip part where the latent electrostatic image support faces the recording medium;

a fixer configured to fix the visible image on the recording medium at a fix nip part where the latent electrostatic image support faces a fixing roller; and one or more of removers configured to remove a solvent of the liquid developer from the visible image at one or both of between the development nip part and the transfer nip part, and between the transfer nip part and the fix nip part, wherein the liquid developer comprises:

an insulating liquid serving as the solvent; and toner fine particles containing a coloring agent and a toner resin, wherein the toner fine particles are dispersed in the insulating liquid, and the liquid developer has a specific resistance of $1\times10^6$ Ωcm or more, when a weight concentration of the toner fine particles in the liquid developer is 20% by weight or more, after the liquid developer is concentrated during image-forming.

22. An image-forming apparatus according to claim 21, wherein one or more of the removers are installed both of between the development nip part and the transfer nip part, and between the transfer nip part and the fix nip part.

23. An image-forming apparatus according to claim 21, wherein the weight concentration of the toner fine particles in the liquid developer is 25% by weight or more at the fix nip part.

24. An image-forming apparatus according to claim 21, wherein one or more of the removers are installed between the development nip part and the transfer nip part, and each of the removers is configured to have:

a removing member which faces the latent electrostatic image support, and removes the solvent of the liquid developer from the visible image; and a solvent-removing electric filed generator configured to generate a desirable electric filed between the latent electrostatic image support and the removing member, wherein the desirable electric field attracts the liquid developer from a non-image part of the latent electrostatic image support to the removing member, and retains the toner fine particles on an image part of the latent electrostatic image support.

25. An image-forming apparatus according to claim 24, wherein two or more of the removers are installed between the development nip part and the transfer nip part, an electric field of one of the removers attracts the liquid developer from the non-image part to a portion on the latent electrostatic image support closer to the removing member, and an electric field of one of the other removers retains the toner fine particles in the liquid developer on the image part, and attracts the solvent of the liquid developer to a portion on the latent electrostatic image support closer to the removing member.

26. An image-forming apparatus comprising:

a latent electrostatic image support configured to have a latent electrostatic image on a surface thereof;

an image-developer configured to supply a liquid developer onto the latent electrostatic image at a development nip part where the image-developer faces the latent electrostatic image support, so as to visualize the latent electrostatic image and to form a visible image;

a transfer configured to have:

a primary transfer which primarily transfers the visible image onto an intermediate transfer at a primary transfer nip part where the latent electrostatic image support faces the intermediate transfer;

a secondary transfer which secondly transfers the visible image on the intermediate transfer onto a recording medium at a secondary transfer nip part where the intermediate transfer faces the recording medium; and a fixer configured to fix the visible image on the recording medium at a fix nip part where the latent electrostatic image support faces a fixing roller; and one or more of removers configured to remove a solvent of the liquid developer from the visible image at one or more of between the development nip part and the primary transfer nip part, between the primary transfer nip part and the secondary transfer nip part, and between the secondary transfer nip part and the fix nip part, wherein the liquid developer comprises:

an insulating liquid serving as the solvent; and toner fine particles containing a coloring agent and a toner resin, wherein the toner fine particles are dispersed in the insulating liquid, and the liquid developer has a specific resistance of $1\times10^6$ Ωcm or more, when a weight concentration of the toner fine particles in the liquid developer is 20% by weight or more, after the liquid developer is concentrated during image-forming.

27. An image-forming apparatus according to claim 26, wherein one or more of the removers are installed two or more of between the development nip part and the primary transfer nip part, between the primary transfer nip part and the secondary transfer nip part, and between the secondary transfer nip part and the fix nip part.

28. An image-forming apparatus according to claim 26, wherein the weight concentration of the toner fine particles in the liquid developer is 25% by weight or more at the fix nip part.

29. An image-forming apparatus according to claim 26, wherein one or more of the removers are installed between the development nip part and the primary transfer nip part, and each of the removers is configured to have:

a removing member which faces the latent electrostatic image support, and removes the solvent of the liquid developer from the visible image; and a solvent-removing electric filed generator configured to generate a desirable electric filed between the latent electrostatic image support and the removing member, wherein the desirable electric field attracts the liquid developer from a non-image part of the latent electrostatic image support to the removing member, and retains the toner fine particles on an image part of the latent electrostatic image support.

30. An image-forming apparatus according to claim 26, wherein two or more of the removers are installed between the development nip part and the primary transfer nip part, an electric field of one of the removers attracts the liquid developer from the non-image part to a portion on the latent electrostatic image support closer to the removing member, and an electric field of one of the other removers retains the toner fine particles in the liquid developer on the image part, and attracts the solvent of the liquid developer to a portion on the latent electrostatic image support closer to the removing member.

* * * * *